US010640908B2

(12) United States Patent
Favaro et al.

(10) Patent No.: US 10,640,908 B2
(45) Date of Patent: May 5, 2020

(54) LAUNDRY WASHING MACHINE

(71) Applicant: Electrolux Appliances Aktiebolag, Stockholm (SE)

(72) Inventors: Daniele Favaro, Venice (IT); Maurizio Del Pos, Pordenone (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 178 days.

(21) Appl. No.: 15/528,383

(22) PCT Filed: Nov. 20, 2014

(86) PCT No.: PCT/EP2014/075178
§ 371 (c)(1),
(2) Date: May 19, 2017

(87) PCT Pub. No.: WO2016/078721
PCT Pub. Date: May 26, 2016

(65) Prior Publication Data

US 2017/0362763 A1 Dec. 21, 2017

(51) Int. Cl.
*D06F 39/02* (2006.01)
*D06F 39/00* (2020.01)
(Continued)

(52) U.S. Cl.
CPC ..... *D06F 39/028* (2013.01); *D06F 33/02* (2013.01); *D06F 37/04* (2013.01); *D06F 37/22* (2013.01);
(Continued)

(58) Field of Classification Search
CPC ..... D06F 39/02; D06F 39/022; D06F 39/028; D06F 39/007
See application file for complete search history.

(56) References Cited

U.S. PATENT DOCUMENTS 6,557,382 B1 * 5/2003 Koike ..... D06F 39/007 68/13 A
2014/0157835 A1 6/2014 Del Pos et al.
(Continued)

FOREIGN PATENT DOCUMENTS

DE 3520202 A1 12/1986
EP 1085118 A2 3/2001
(Continued)

OTHER PUBLICATIONS

International Search Report dated Mar. 27, 2015 in corresponding International Application No. PCT/EP2014/075178.
(Continued)

*Primary Examiner* — Joseph L. Perrin
(74) *Attorney, Agent, or Firm* — RatnerPrestia

(57) ABSTRACT

A laundry washing machine (1) includes an outer casing (2), a washing tub (3), a rotatable drum housed in axially rotatable manner inside the washing tub (3), a detergent dispenser (10), a fresh-water supply circuit (12) for selectively channelling a flow of fresh water towards the detergent dispenser (10) and/or the washing tub (3), and an internal water softening device (14) capable of reducing the hardness degree of the fresh water. The laundry washing machine (1) further includes: at least a main drawer (16, 74) which is fitted/inserted in extractable manner into a corresponding substantially basin-shaped, drawer housing (18, 73) which is located/recessed inside the outer casing (2), and is provided with a substantially basin-shaped, manually tillable regeneration-agent compartment (20); a first water-supply line (19) which is structured for selectively channelling a flow of fresh water into said regeneration-agent compartment (20) so as to form some brine; a brine container (34) which is located underneath the drawer housing (18, 73) and communicates with the bottom of the drawer housing (18, 73) so as to allow the brine to freely flow by
(Continued)

gravity from a basin-shaped bottom portion (32) of said drawer housing (18, 73) into the same brine container (34); and an electrically-powered pump (35) able to selectively pump the brine from said brine container (34) to the water softening device (14).

25 Claims, 12 Drawing Sheets

(51) Int. Cl.

| | |
|---|---|
| ***D06F 33/02*** | (2006.01) |
| ***D06F 37/04*** | (2006.01) |
| ***D06F 37/22*** | (2006.01) |
| ***D06F 39/08*** | (2006.01) |
| ***D06F 39/12*** | (2006.01) |

(52) U.S. Cl.
CPC ..... *D06F 39/005* (2013.01); *D06F 39/007* (2013.01); *D06F 39/02* (2013.01); *D06F 39/088* (2013.01); *D06F 39/12* (2013.01); *D06F 39/022* (2013.01)

(56) References Cited

U.S. PATENT DOCUMENTS

| | | | |
|---|---|---|---|
| 2014/0157836 | A1 | 6/2014 | Zattin et al. |
| 2014/0165665 | A1 | 6/2014 | Del Pos et al. |
| 2014/0165666 | A1 | 6/2014 | Del Fos et al. |
| 2015/0107309 | A1 | 4/2015 | Favaro et al. |
| 2015/0107310 | A1 | 4/2015 | Del Pos et al. |
| 2015/0204005 | A1 | 7/2015 | Favaro et al. |

FOREIGN PATENT DOCUMENTS

| | | | |
|---|---|---|---|
| EP | 2554736 | A1 | 2/2013 |
| EP | 2554738 | A1 | 2/2013 |
| EP | 2562303 | A2 | 2/2013 |
| EP | 2657389 | A1 | 10/2013 |
| EP | 2679716 | A1 | 1/2014 |
| EP | 2733249 | A2 | 5/2014 |
| WO | 2013045299 | A1 | 4/2013 |
| WO | 2013098068 | A1 | 7/2013 |
| WO | 2013160211 | A1 | 10/2013 |
| WO | 2014121820 | A1 | 8/2014 |
| WO | 2014121830 | A1 | 8/2014 |

OTHER PUBLICATIONS

International Search Report dated Dec. 22, 2014 in related International Application No. PCT/EP2014/075171.
International Search Report dated Mar. 23, 2015 in related International Application No. PCT/EP2014/075147.
Final Office Action for U.S. Appl. No. 15/528,386, dated Feb. 4, 2019—14 pages.
Non Final Office Actionn for U.S. Appl. No. 15/528,386, dated Sep. 17, 2018, 16 pages.
Non Final Office Action for U.S. Appl. No. 15/528,388, dated May 21, 2019, 26 pages.
Non Final Office Action for U.S. Appl. No. 15/528,386, dated Jun. 12, 2019, 17 pages.
Final Office Action for U.S. Appl. No. 15/528,388, dated Sep. 16, 2019, 11 pages.

* cited by examiner

Fig. 4
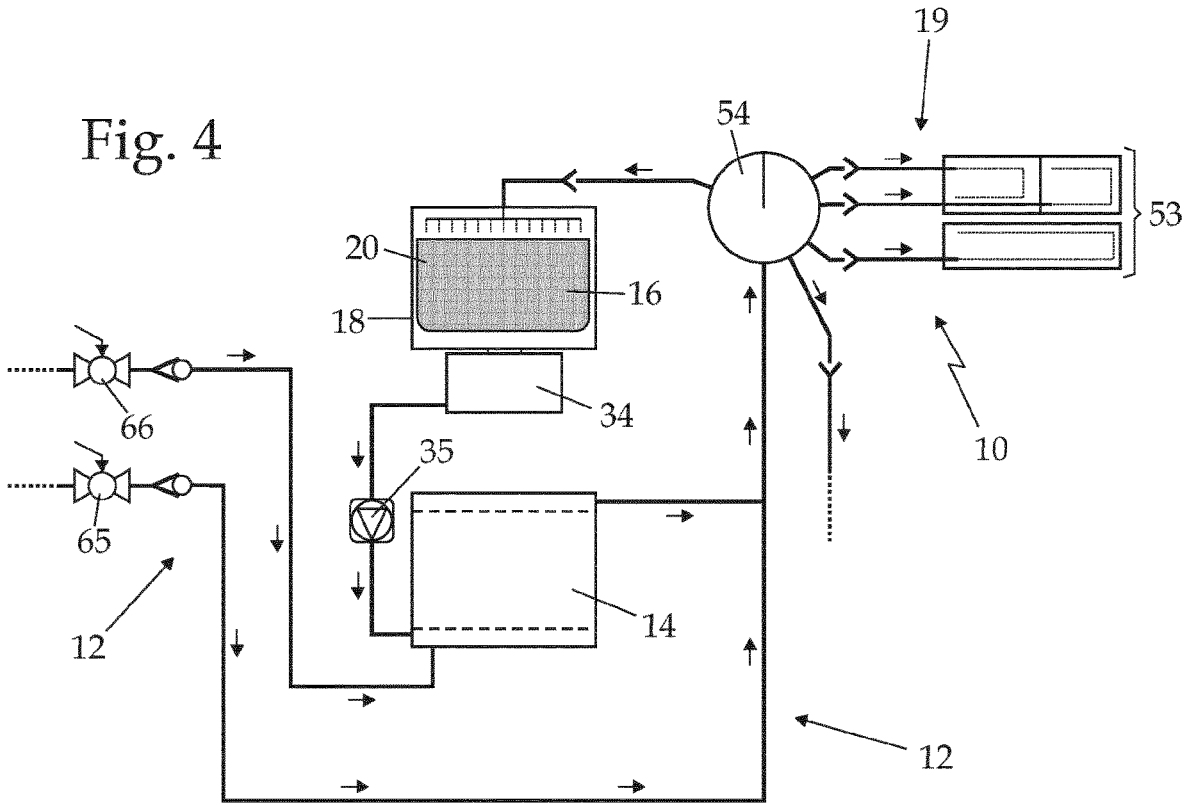
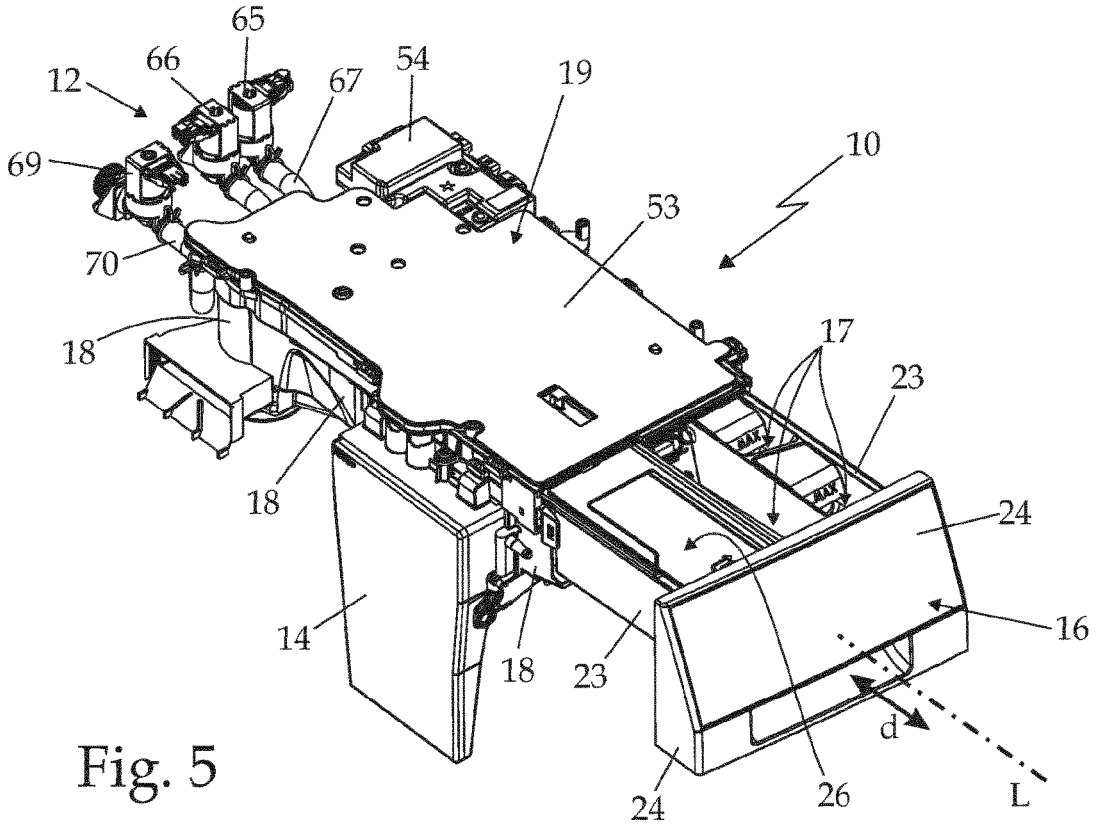
Fig. 5

Fig. 11
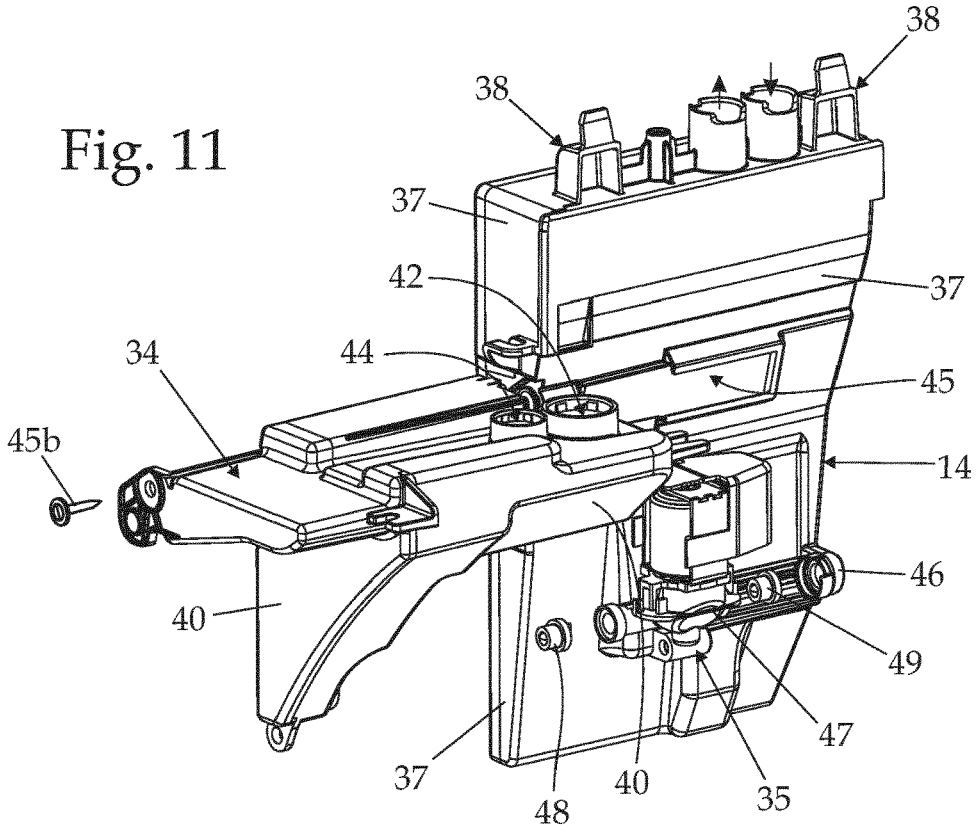
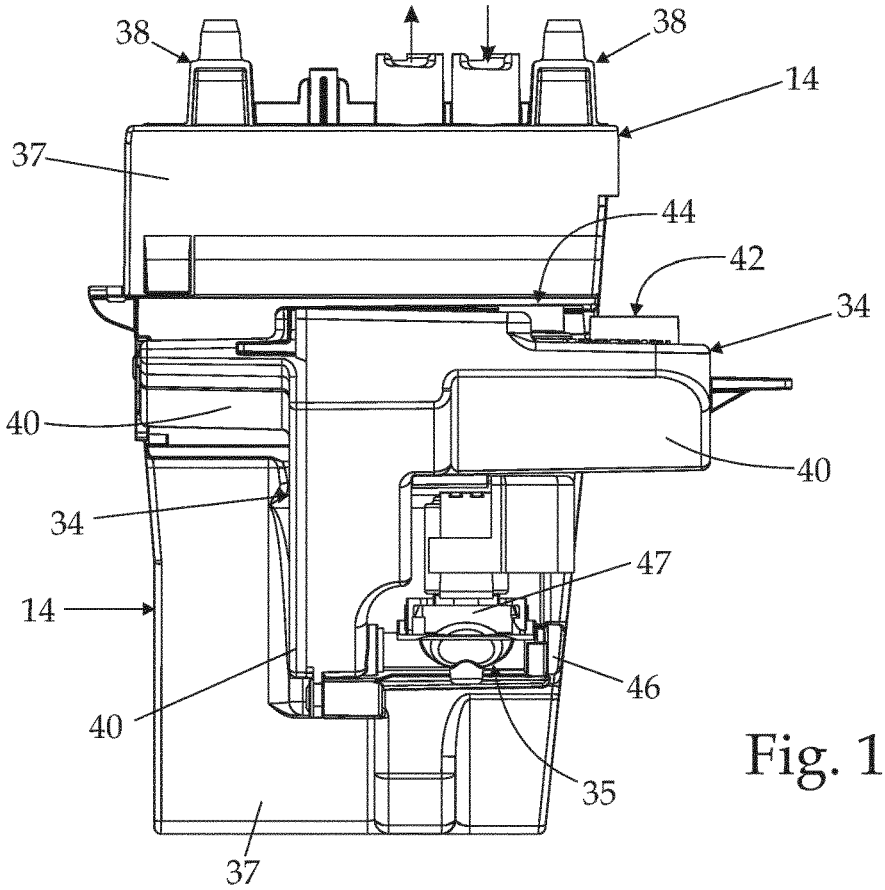
Fig. 12

LAUNDRY WASHING MACHINE

BACKGROUND

The present invention relates to a laundry washing machine.

More in particular, the present invention relates to a front-loading home laundry washing machine, to which the following description refers purely by way of example without this implying any loss of generality.

As is known, a front-loading home laundry washing machine generally comprises: a substantially parallelepiped-shaped outer boxlike casing structured for resting on the floor; a substantially horizontally-oriented and approximately cylindrical washing tub which is usually suspended in floating manner inside the casing, with the front mouth directly facing a laundry loading/unloading through opening realized in the front wall of the casing; a substantially cylindrical, cup-shaped rotatable drum structured for housing the laundry to be washed, and which is fitted inside the washing tub with the concavity facing the laundry loading/unloading opening, and is supported by the washing tub in axially rotatable manner so as to be able to freely rotate inside the washing tub about its substantially horizontally-oriented, longitudinal axis; a substantially cylindrical, elastically-deformable bellows which watertight connects the front mouth of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; and an electrically-powered motor assembly which is structured for driving into rotation the rotatable drum about its longitudinal axis inside the washing tub.

This type of laundry washing machine furthermore comprises: a detergent dispenser which is located inside the boxlike casing, immediately above the washing tub, and is structured for selectively feeding into the washing tub, according to the washing cycle manually-selected by the user, a given amount of detergent, softener and/or other washing agent suitably mixed with fresh water arriving from the water mains; a fresh-water supply circuit which is structured for selectively drawing fresh water from the water mains according to the washing cycle manually-selected by the user, and channelling said fresh water to the detergent dispenser or directly to the washing tub; and finally an appliance control panel which is generally located on the front wall of the casing, above the laundry loading/unloading opening, and is structured for allowing the user to manually select the desired washing-cycle.

In addition to the above, high-end front-loading laundry washing machines may optionally have an internal water softening device which is located along the fresh-water supply circuit, and is structured to selectively reduce the hardness degree of the tap water channelled towards the detergent dispenser and the washing tub. The use of softened water during the washing cycle, in fact, significantly improves cleaning performances.

More in detail, the water softening device is generally internally provided with a given amount of ion-exchange resins which are capable of retaining the calcium and magnesium ions (Ca++ and Mg++) dissolved in the water flowing through the same water softening device, so as to reduce the hardness degree of the tap water directed towards the detergent dispenser and the washing tub.

In addition to the above, since the water softening capabilities of the ion-exchange resins are used to quickly drop away after a limited number of washing cycles, this high-end laundry washing machines are generally provided with an internal reservoir of salt (NaCl) to be used for selectively producing some brine (i.e. salt water) which is periodically channeled into the water softening device to regenerate the ion-exchange resins located therein. Salt water, in fact, is able to remove from the ion-exchange resins the calcium and magnesium ions previously combined/fixed to said resins.

WO2013/160211 discloses a front-loading home laundry washing machine wherein the salt to be used in the regeneration process of the ion-exchange resins is stowed into a cup-shaped container which has a mesh structure and is located into a regeneration-agent drawer which, in turn, is fitted in manually extractable manner on front wall of the casing, beside the detergent drawer of the detergent dispenser. The brine formed into the regeneration-agent drawer is fed to the water softening device by means of an electric pump assembly that sucks the brine directly from the bottom of regeneration-agent drawer.

Unluckily the hydraulic fittings necessary to floatingly connect the suction of pump assembly directly to the bottom of the regeneration-agent drawer are rather costly and significantly increase the overall production costs of the laundry washing machine.

Furthermore, the pump assembly does not allow a prompt and precise dosage of the brine channeled into the water softening device, because the amount of brine accumulating on the bottom of regeneration-agent drawer per time unit is highly dependent on the compactness of the salt grains contained in the regeneration-agent drawer.

Lastly, when the user pours the salt into the cup-shaped container, some salt grains may accidentally fall on the bottom of the regeneration-agent drawer and block up the suction of the pump assembly with all problems that follows.

SUMMARY OF SELECTED INVENTIVE ASPECTS

An aim of the present invention is to simplify the connection of pump assembly to the regeneration-agent drawer to eliminate the drawbacks referred above.

In compliance with the above aims, according to an aspect of the present invention there is provided a laundry washing machine comprising an outer casing and, inside said outer casing, a washing tub, a rotatable drum housed in axially rotatable manner inside the washing tub and structured for housing the laundry to be washed, a detergent dispenser which is structured for supplying detergent into the washing tub, a fresh-water supply circuit which is structured for selectively channelling a flow of fresh water from the water mains towards the detergent dispenser and/or the washing tub, and an internal water softening device comprising a water-softening-agent container filled with a water softening agent capable of reducing the hardness degree of the fresh water directed towards the detergent dispenser or the washing tub;

the laundry washing machine furthermore comprising: at least a main drawer which is fitted/inserted in extractable manner into a corresponding substantially basin-shaped, drawer housing located inside the outer casing, and which is provided with a substantially basin-shaped, regeneration-agent compartment structured for being manually fillable with a given amount of consumable salt or other regeneration agent capable of performing a regeneration of the water softening function of said water softening agent; and a water-supply line which is structured for selectively channelling a flow of fresh water into said regeneration-agent compartment so as to form some brine;

the laundry washing machine being characterized in that the drawer housing has a substantially basin-shaped, bottom portion for catching the brine coming out of said regeneration-agent compartment; and by additionally comprising: a brine container which is located underneath the drawer housing and fluidically communicates with said substantially basin-shaped, bottom portion so as to allow the brine to freely flow by gravity from said basin-shaped bottom portion into the same brine container; and an electrically-powered pump assembly able to selectively pump the brine from said brine container to the water softening device.

Preferably, though not necessarily, the laundry washing machine is furthermore characterized in that the brine container comprises a tank which is distinct and separated from said drawer housing, and is provided with first mechanical coupling means structured for allowing the rigid fastening and/or fluidical connection of the same tank to the bottom of said drawer housing.

Preferably, though not necessarily, the laundry washing machine is furthermore characterized in that said tank is provided with second mechanical coupling means structured for allowing the rigid fastening and/or fluidical connection of the same tank to the water-softening-agent container of said water softening device.

Preferably, though not necessarily, the laundry washing machine is furthermore characterized in that said brine container additionally comprises sensor means capable of detecting the level of the water stored inside the tank and/or the salinity degree of the water stored into the tank.

Preferably, though not necessarily, the laundry washing machine is furthermore characterized in that the brine container is a discrete modular member which is firmly attached to the water-softening-agent container of said water softening device with the interposition of said pump assembly.

Preferably, though not necessarily, the laundry washing machine is furthermore characterized in that said pump assembly remains trapped between the water-softening-agent container of said water softening device and said brine container.

Preferably, though not necessarily, the laundry washing machine is furthermore characterized in that said tank and said water-softening-agent container form, when coupled to one another and in between themselves, a receiving seat dimensioned to accommodate said pump assembly.

Preferably, though not necessarily, the laundry washing machine is furthermore characterized in that the water-softening-agent container of said water softening device is provided with third mechanical coupling means structured for allowing the fastening of the same water-softening-agent container to said drawer housing.

Preferably, though not necessarily, the laundry washing machine is furthermore characterized in that said tank, said water softening device and said pump assembly form a discrete intermediate modular assembly which is attached to said drawer housing.

Preferably, though not necessarily, the laundry washing machine is furthermore characterized in that said tank is dimensioned to contain an amount of brine approximately equal to the whole amount of brine to be pumped into the water-softening-agent container of said water softening device for performing the regeneration process of the water softening agent contained into the same water-softening-agent container.

Preferably, though not necessarily, the laundry washing machine is furthermore characterized in that said tank is dimensioned to contain an amount of brine approximately equal to a submultiple of the whole amount of brine to be pumped into the water-softening-agent container of said water softening device for performing the regeneration process of the water softening agents contained into the same water-softening-agent container.

Preferably, though not necessarily, the laundry washing machine is furthermore characterized in that said tank is dimensioned to contain an amount of brine greater than 100 ml.

Preferably, though not necessarily, the laundry washing machine is furthermore characterized in that said tank has, on top, a first opening for the entrance of the brine and a second opening for air vent.

Preferably, though not necessarily, the laundry washing machine is furthermore characterized in that said tank directly communicates with the basin-shaped bottom portion of the drawer housing via a first vertical pipe-extension that protrudes downwards from the bottom of the drawer housing and fits into a complementary brine inlet opening formed on top wall of said tank.

Preferably, though not necessarily, the laundry washing machine is furthermore characterized in that said tank fluidically communicates with the inside of the drawer housing via a second vertical pipe-extension that protrudes downwards from the bottom of the drawer housing and fits into a complementary air vent opening formed on top wall of said tank, next to the brine inlet opening.

Preferably, though not necessarily, the laundry washing machine is furthermore characterized in that said second vertical pipe-extension additionally protrudes upwards into the drawer housing within the perimeter of said basin-shaped bottom portion, so as to arrange its upper mouth at a given high from the basin-shaped bottom portion thus to prevent the brine from freely falling into the same tank.

Preferably, though not necessarily, the laundry washing machine is furthermore characterized in that said main drawer additionally comprises a partitioning septum which extends inside the regeneration-agent compartment above a brine outlet of the regeneration-agent compartment, and has a water-permeable structure which is designed to slow down the outflow of the brine from the regeneration-agent compartment via the brine outlet for causing a temporary stagnation of the water poured into the regeneration-agent compartment above the partitioning septum.

Preferably, though not necessarily, the laundry washing machine is furthermore characterized in that said brine outlet is a pass-through opening which is formed on the bottom of the regeneration-agent compartment, and is shaped/dimensioned to allow the brine formed inside the regeneration-agent compartment to freely fall on the basin-shaped bottom portion of said drawer housing.

Preferably, though not necessarily, the laundry washing machine is furthermore characterized in that said partitioning septum is structured to allow the passage of the brine through the same partitioning septum with a flowrate which is lower than that of the fresh water poured into the regeneration-agent compartment via said water-supply line.

Preferably, though not necessarily, the laundry washing machine is furthermore characterized in that said partitioning septum causes a temporary increase of the level of water above the same partitioning septum.

Preferably, though not necessarily, the laundry washing machine is furthermore characterized in that said partitioning septum causes, during stagnation of the water, a quick increase of the level of water inside the regeneration-agent compartment, up to a maximum value above the partitioning septum, and then a slow lowering of the level of water down to the same partitioning septum.

Preferably, though not necessarily, the laundry washing machine is furthermore characterized in that the regeneration-agent compartment remains empty of brine at the end of the temporary stagnation of the water.

Preferably, though not necessarily, the laundry washing machine is furthermore characterized in that said main drawer is additionally provided with one or more substantially basin-shaped, detergent compartments which are arranged beside the regeneration-agent compartment and are each structured for being manually fillable with a given amount of detergent, softener or other washing agent; and in that the detergent dispenser furthermore comprises a drawer flush circuit which is connected to the fresh-water supply circuit, and is structured for selectively pouring the fresh water of the water mains into any one of said detergent compartments, so as to selectively flush the detergent, softener or other washing agent out of the same detergent compartment and down onto the bottom of said drawer housing.

Preferably, though not necessarily, the laundry washing machine is furthermore characterized in that the detergent dispenser comprises: a second drawer which is fitted/inserted in extractable manner into a corresponding substantially basin-shaped, second drawer housing which is located/recessed inside the outer casing, and is provided with one or more detergent compartments each structured for being manually fillable with a given amount of detergent, softener or other washing agent.

Preferably, though not necessarily, the laundry washing machine is furthermore characterized in that the detergent dispenser also comprises a drawer flush circuit which is connected to the fresh-water supply circuit, and is structured for selectively pouring the fresh water of the water mains into any one of said detergent compartments, so as to selectively flush the detergent, softener or other washing agent out of the same detergent compartment and down onto the bottom of the drawer housing.

Preferably, though not necessarily, the laundry washing machine is furthermore characterized in that said second drawer is arranged horizontally beside the main drawer so that both drawers are independently movable inside the respective drawer housings parallel to one another.

Preferably, though not necessarily, the laundry washing machine is furthermore characterized in that said fresh-water supply line is incorporated into said drawer flush circuit.

Preferably, though not necessarily, the laundry washing machine is furthermore characterized in that said drawer flush circuit comprises: water delivery member which forms the upper lid of said drawer housing, so as to be located immediately above said first and/or second drawer when said drawer/s is/are completely inserted/recessed into the corresponding drawer housing/s, and is provided with a number of water-delivery portions each suitably structured to allow the outflow of water from the water delivery member towards the beneath located first or second drawer; and an electrically-operated, flow-diverter which is connected to fresh-water supply circuit and/or to water softening device for receiving unsoftened or softened fresh water, and is structured to selectively channel said softened or unsoftened fresh water towards any one of the water-delivery portions of the water delivery member.

Preferably, though not necessarily, the laundry washing machine is furthermore characterized in that said pump assembly comprises an electrically-powered volumetric pump.

Preferably, though not necessarily, the laundry washing machine is furthermore characterized in that the water-softening-agent container of said water softening device contains a given amount of ion-exchange resins capable of retaining the calcium and magnesium ions dissolved in the water that flows through the same water-softening-agent container.

Preferably, though not necessarily, the laundry washing machine is furthermore characterized in that the regeneration-agent compartment is dimensioned to accommodate an amount of consumable salt or other regeneration agent sufficient for performing one or more regeneration processes of water softening capabilities of the water softening agent contained into the water-softening-agent container of said water softening device.

BRIEF DESCRIPTION OF THE DRAWINGS

A non-limiting embodiment of the present invention will now be described, by way of example, with reference to the accompanying drawings, in which:

FIG. 4 is a schematic view of part of the hydraulic circuit of the FIG. 1 laundry washing machine;

FIG. 5 is a perspective view of the detergent dispensing assembly of the FIG. 1 laundry washing machine, with parts removed for clarity;

FIG. 11 is an enlarged and partially exploded perspective view of part of the detergent dispensing assembly shown in FIGS. 6 and 7, with parts removed for clarity;

FIG. 12 is an enlarged side view of the part of detergent dispensing assembly shown in FIG. 9, with parts removed for clarity;

FIG. 17 is a perspective view of the upper lid of the drawer housing of the detergent dispensing assembly shown in FIGS. 6 and 7; whereas

DETAILED DESCRIPTION OF EXAMPLE EMBODIMENTS

Figure 2:
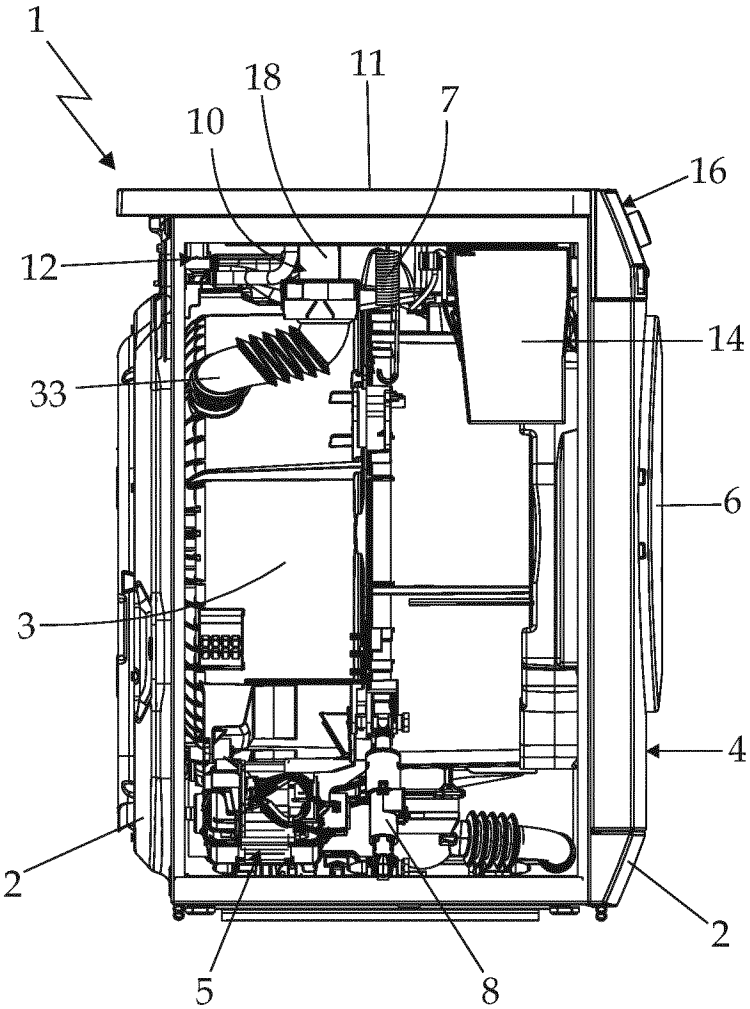
FIG. 2 is a side view of the FIG. 1 laundry washing machine, with parts removed for clarity.
Figure 1:
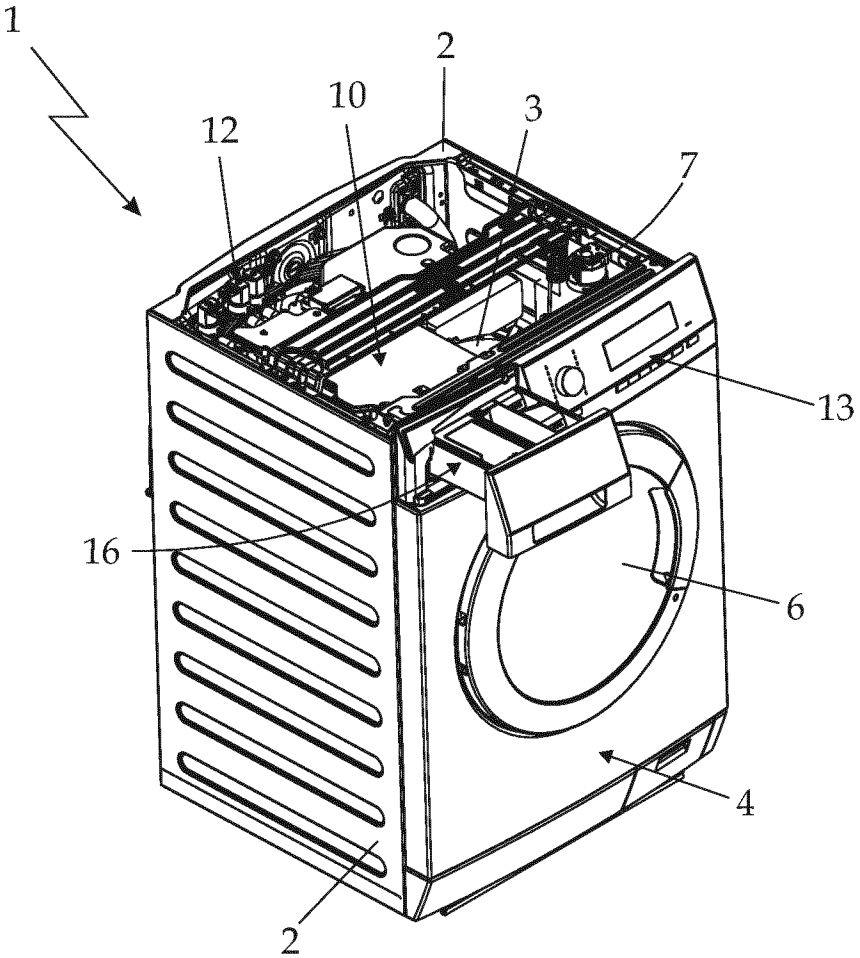
FIG. 1 is a perspective view of a laundry washing machine realized in accordance with the teachings of the present invention, with parts removed for clarity.
Figure 3:
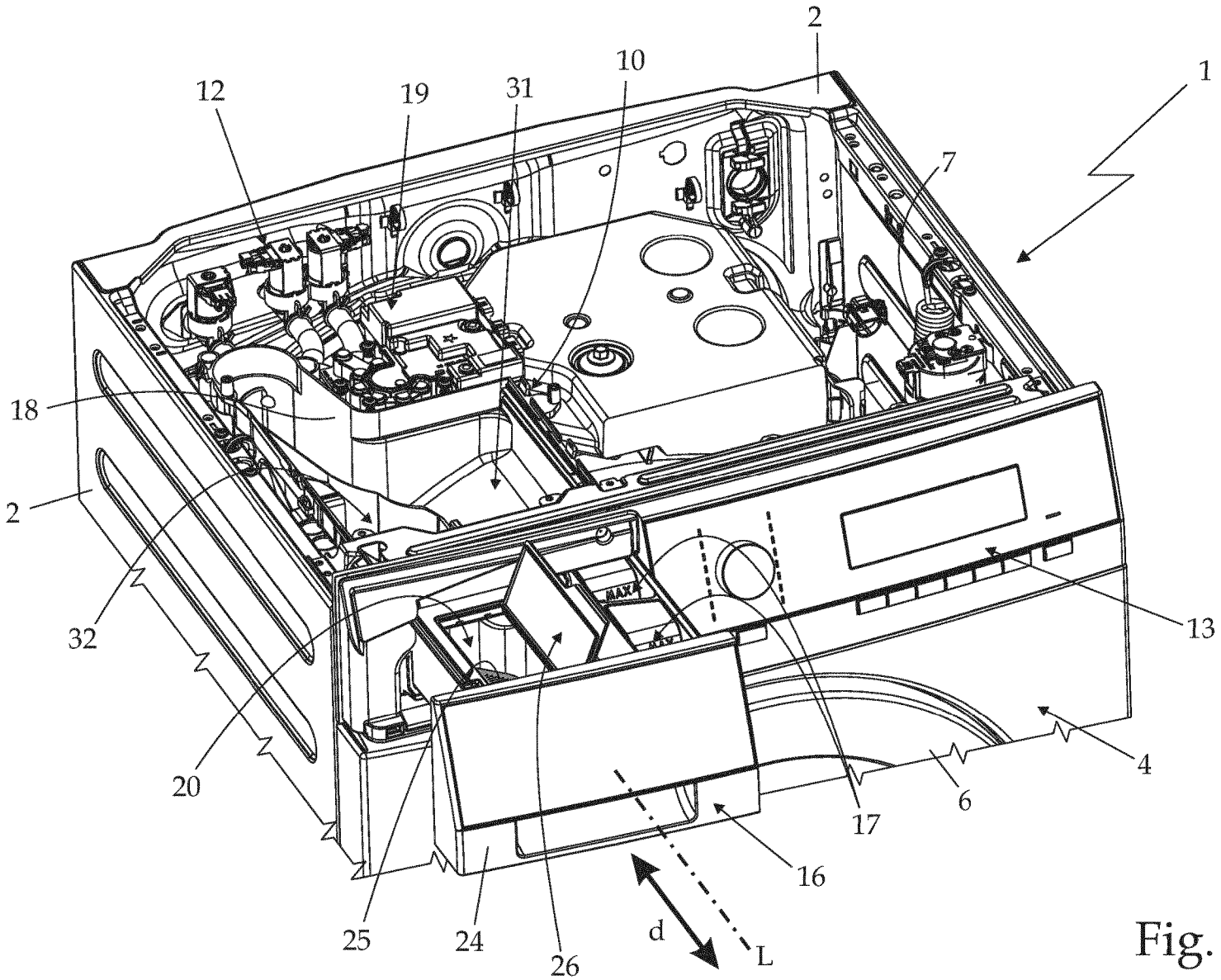
FIG. 3 is an enlarged perspective view of the top of the FIG. 1 laundry washing machine, with parts removed for clarity.

With reference to FIGS. 1, 2 and 3, reference number 1 indicates as a whole a laundry washing machine 1 which preferably basically comprises: a preferably substantially parallelepiped-shaped, outer boxlike casing 2 structured for resting on the floor; a preferably substantially horizontally-oriented, approximately cylindrical washing tub 3 which is arranged inside the casing 2 with the mouth directly facing a laundry loading/unloading pass-through opening realized in the front wall 4 of the outer casing 2; a substantially cylindrical, cup-shaped rotatable drum (not shown) which is structured for housing the laundry to be washed, and is fitted in axially rotatable manner inside the washing tub 3 with the concavity facing the front opening or mouth of washing tub 3, so as to be able to freely rotate about its longitudinal axis inside the washing tub 3; an electrically-powered motor assembly 5 which is structured for driving into rotation the rotatable drum (not shown) about its longitudinal axis inside the washing tub 3; and a porthole door 6 which is hinged to the front wall 4 of casing 2 so as to be movable/rotatable to and from a closing position in which the door 6 closes the laundry loading/unloading opening on front wall 4 for watertight sealing the washing tub 4.

In the example shown, in particular, the rotatable drum (not shown) of laundry washing machine 1 is preferably arranged inside the washing tub 3 with the drum rotation axis locally substantially coaxial to the longitudinal axis of washing tub 3, i.e. oriented substantially horizontally, and with the circular front opening or mouth of the drum directly aligned and faced to the circular front opening or mouth of washing tub 3, so as to receive the laundry to be washed through the laundry loading/unloading opening realized on front wall 4.

The washing tub 3, in turn, is preferably suspended in floating manner inside the casing 2 via a suspension system that preferably, though not necessarily, comprises at least one, and preferably a couple of upper coil springs 7 connecting the upper portion of washing tub 3 to the top of casing 2, and preferably at least one, and preferably a couple of vibration dampers 8 connecting the bottom portion of washing tub 3 to the bottom of casing 2. Moreover the laundry washing machine 1 is preferably provided with a substantially cylindrical elastically-deformable bellows (not shown) which watertight connects the front mouth of washing tub 3 to the laundry loading/unloading opening realized on front wall 4 of casing 2.

With reference to FIGS. 1, 2, 3 and 4, the laundry washing machine 1 furthermore comprises: a detergent dispenser 10 which is located inside the casing 2 preferably above the washing tub 3 and preferably, though not necessarily, immediately underneath the upper worktop or top wall 11 of casing 2, and is structured for selectively feeding into the washing tub 3, according to the washing cycle manually-selected by the user, a given amount of detergent, softener and/or other washing agent suitably mixed with fresh water; and a fresh-water main supply circuit 12 which is connectable directly to the water mains, and is structured for selectively channelling, according to the washing cycle manually-selected by the user, a flow of fresh water from the water mains to the detergent dispenser 10 or directly to the washing tub 3. Preferably the laundry washing machine 1 additionally comprises an appliance control panel 13 which is preferably located on front wall 4 of casing 2, above the laundry loading/unloading opening and preferably also immediately beneath the upper worktop or top wall 11 of casing 2, and is structured to allow the user to manually select the desired washing cycle among a number of available washing cycles.

In addition to the above, with reference to FIGS. 2 and 4-10, the laundry washing machine 1 furthermore comprises an internal water softening device 14 which is located inside the boxlike casing 2 along the fresh-water supply circuit 12 or the detergent dispenser 10, and is structured for selectively reducing, during each washing cycle, the hardness degree of the tap water that fresh-water supply circuit 12 channels towards detergent dispenser 10 or washing tub 3.

More in detail, the water softening device 14 basically consists in a closed container which has a water inlet and a water outlet fluidically connected to the fresh-water supply circuit 12 and/or the detergent dispenser 10 so as to be crossed by the tap water directed towards the washing tub 3, and which furthermore is filled with a given amount of ion-exchange resins capable of retaining the calcium and magnesium ions ($Ca^{++}$ and $Mg^{++}$) dissolved in the water flowing through the same container, so as to reduce the hardness degree of the tap water directed towards the washing tub 3.

In the example shown, in particular, the water softening device 14 is preferably located inside the boxlike casing 2 adjoined to the detergent dispenser 10, and is preferably fluidically connected directly to detergent dispenser 10 so as to be crossed by the fresh water flowing towards the washing tub 3 via the same detergent dispenser 10.

With reference to FIGS. 1-10, detergent dispenser 10 in turn basically comprises: a detergent drawer 16 which is provided with one or more substantially basin-shaped, detergent compartments 17 (three detergent compartments 17 in the example shown) each structured for being manually fillable with a given amount of detergent, softener or other washing agent, and which is fitted/inserted in manually extractable manner into a corresponding substantially basin-shaped, drawer housing 18 which, in turn, is located/recessed inside the casing 2 above washing tub 3, and whose entrance is preferably located on front wall 4 of casing 2, above the laundry loading/unloading opening realized on the same front wall 4; and a drawer flush circuit 19 which is connected to the fresh-water supply circuit 12, and is structured for selectively channelling/pouring, when the detergent drawer 16 is completely fitted/inserted into drawer housing 18, the fresh water of the water mains into any one of the detergent compartments 17 of detergent drawer 16 so as to selectively flush the detergent, softener or other washing agent out of the same detergent compartment 17 and down onto the bottom of drawer housing 18.

More in detail, detergent drawer 16 is preferably movable inside the drawer housing 18 parallel to the substantially horizontally-oriented, longitudinal axis L of drawer housing 18 between:

- a retracted position (see FIG. 2) in which detergent drawer 16 is completely fitted/inserted into drawer housing 18, so as to be almost completely recessed into the front wall 4 of casing 2; and
- a completely extracted position (see FIGS. 1, 3, 5 and 7) in which detergent drawer 16 partly juts out from the front wall 4 of casing 2, so as to expose the one or more detergent compartments 17 at once.

In other words, detergent drawer 16 is movable inside the drawer housing 18 in a substantially horizontally-oriented, displacement direction d which is locally substantially parallel to the longitudinal axis L of both drawer housing 18 and detergent drawer 16, between:

- a retracted position (see FIG. 2) in which detergent drawer 16 is almost completely recessed into the front wall 4 of casing 2 and the one or more detergent compartments 17 of detergent drawer 16 are inaccessible to the user; and
- a completely extracted position (see FIGS. 3, 5 and 7) in which detergent drawer 16 partly juts out from the front wall 4 of casing 2, so that all detergent compartments 17 of detergent drawer 16 are fully accessible to the user.

In the example shown, in particular, the entrance of drawer housing 18 is preferably located on front wall 4 of casing 2, immediately underneath the upper worktop or top wall 11 of casing 2 and substantially horizontally aligned beside the appliance control panel 13. Moreover the longitudinal axis L of both detergent drawer 16 and drawer housing 18, and as a result the displacement direction d of detergent drawer 16, are preferably locally substantially perpendicular to front wall 4 of casing 2.

Preferably each detergent compartment 17 is furthermore dimensioned to contain a given amount of detergent, softener or other washing agent sufficient for performing only a single washing cycle.

In addition to the above, detergent drawer 16 preferably has, inside each detergent compartment 17, a siphon assembly 22 which is suitably structured/dimensioned to selectively channel the mixture of water and detergent, softener or other washing agent formed inside the detergent compartment 17 out of the same detergent compartment 17 and down onto the bottom of drawer housing 18.

As an alternative to the siphon assembly 22, detergent drawer 16 may have, on the bottom of the detergent compartment 17, a large pass-through opening which is suitably shaped/dimensioned to allow the mixture of water and detergent, softener or other washing agent formed inside the same detergent compartment 17 to freely fall on the bottom of drawer housing 18.

The drawer flush circuit 19, in turn, is preferably structured for directly pouring, when detergent drawer 16 is placed in the retracted position, a shower of water droplets by gravity selectively and alternatively into any one of the detergent compartments 17 of detergent drawer 16, so as to selectively flush the detergent, softener or other washing agent out of the same detergent compartment 17 and down onto the bottom of drawer housing 18.

With reference to FIGS. 3, 8, 9 and 10, detergent drawer 16 is furthermore provided with a substantially basin-shaped, regeneration-agent compartment 20 which is located beside the one or more detergent compartments 17, and is structured for being manually fillable with a given amount of consumable salt (NaCl) or other regeneration agent suitable to be used in the regeneration process of the ion-exchange resins of the water softening device 14.

More in details, the regeneration-agent compartment 20 is preferably arranged, on detergent drawer 16, beside the one or more detergent compartments 17, so that both detergent compartment/s 17 and regeneration-agent compartment 20 are allowed to almost contemporaneously come out from the front wall 4 of casing 2 when detergent drawer 16 moves from the retracted position to the extracted position.

In other words, the regeneration-agent compartment 20 is preferably arranged on detergent drawer 16 beside the one or more detergent compartments 17 transversally to the displacement direction d of detergent drawer 16, i.e. transversally to the longitudinal axis L of detergent drawer 16, so that the detergent compartment/s 17 and the regeneration-agent compartment 20 are arranged on opposite sides of a substantially vertically-oriented, reference plane which is parallel to the displacement direction d of detergent drawer 16 inside drawer housing 18, i.e. parallel to the longitudinal axis L of detergent drawer 16.

Detergent drawer 16 is therefore movable inside drawer housing 18 in the substantially horizontally-oriented, displacement direction d between:

- a retracted position (see FIG. 2) in which detergent drawer 16 is completely recessed into the front wall 4 of casing 2, so that both the detergent compartment/s 17 and the regeneration-agent compartment 20 are inaccessible to the user; and
- a completely extracted position (see FIGS. 1 and 3) in which detergent drawer 16 partly juts out from the front wall 4 of casing 2, so that both the detergent compartment/s 17 and the regeneration-agent compartment 20 are simultaneously fully accessible to the user.

Preferably the regeneration-agent compartment 20 is moreover dimensioned to accommodate/contain an amount of consumable salt (NaCl) or other regeneration agent sufficient for performing a plurality of regeneration processes of the ion-exchange resins of the water softening device 11.

Figure 9:
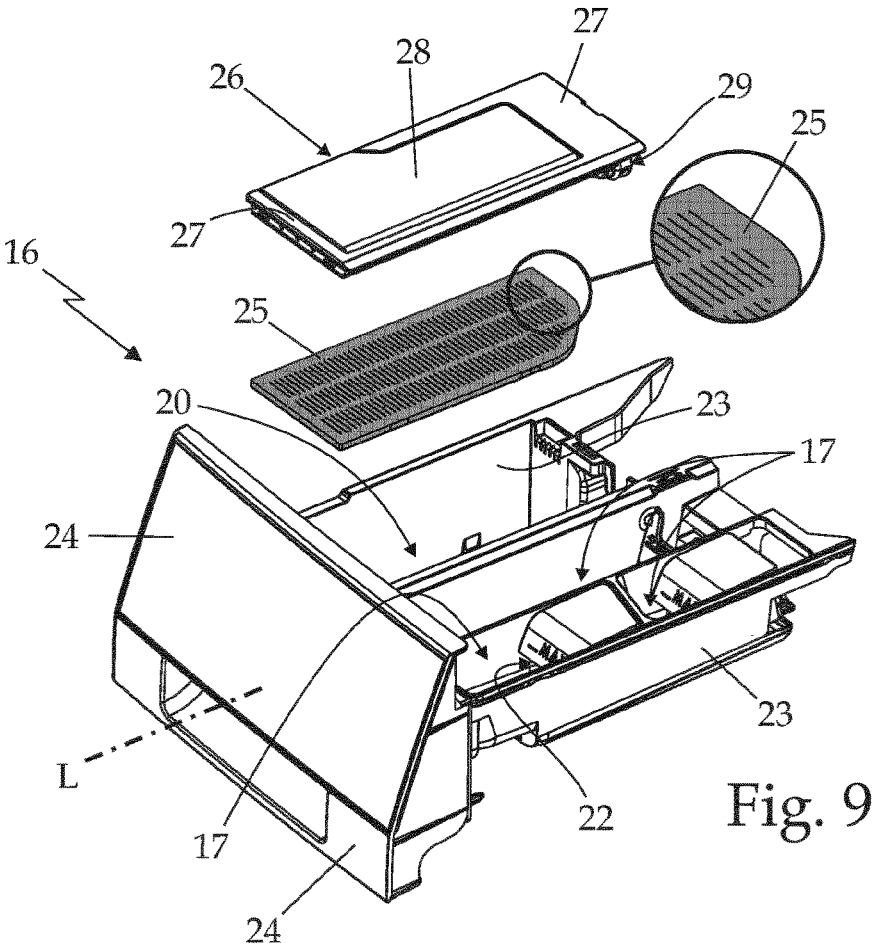
FIG. 9 is a partially exploded perspective view of the detergent drawer of the detergent dispensing assembly shown in FIGS. 6 and 7, with parts removed for clarity.
Figure 10:
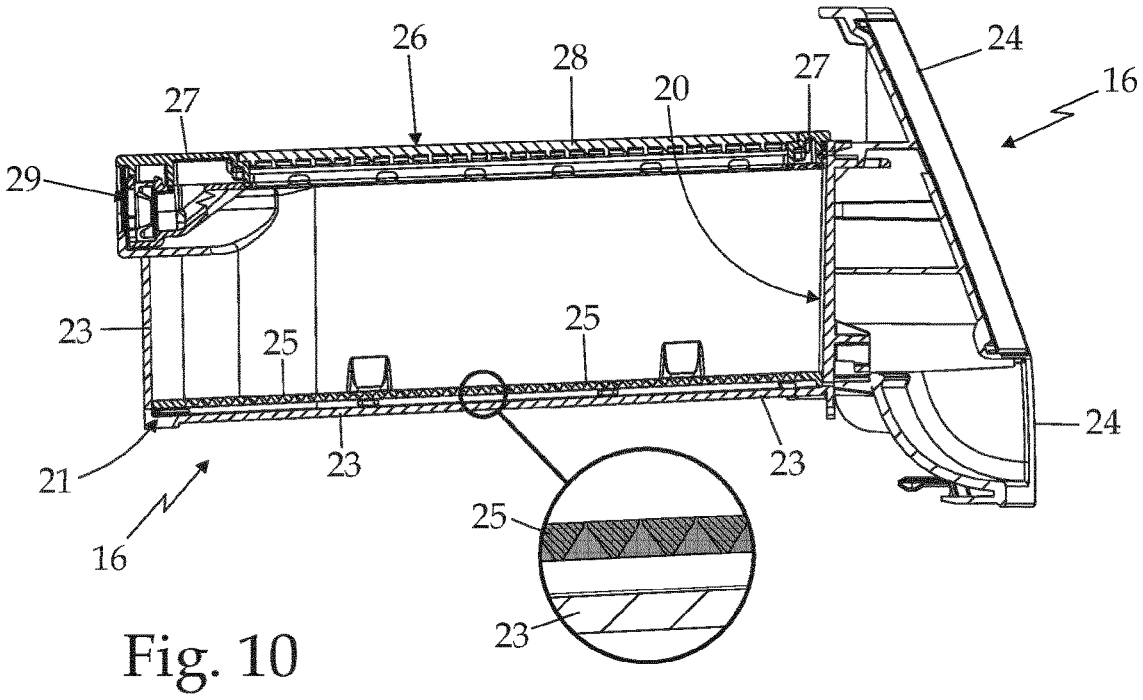
FIG. 10 is a sectioned side view of the FIG. 9 detergent drawer, with parts removed for clarity.
Figure 13:
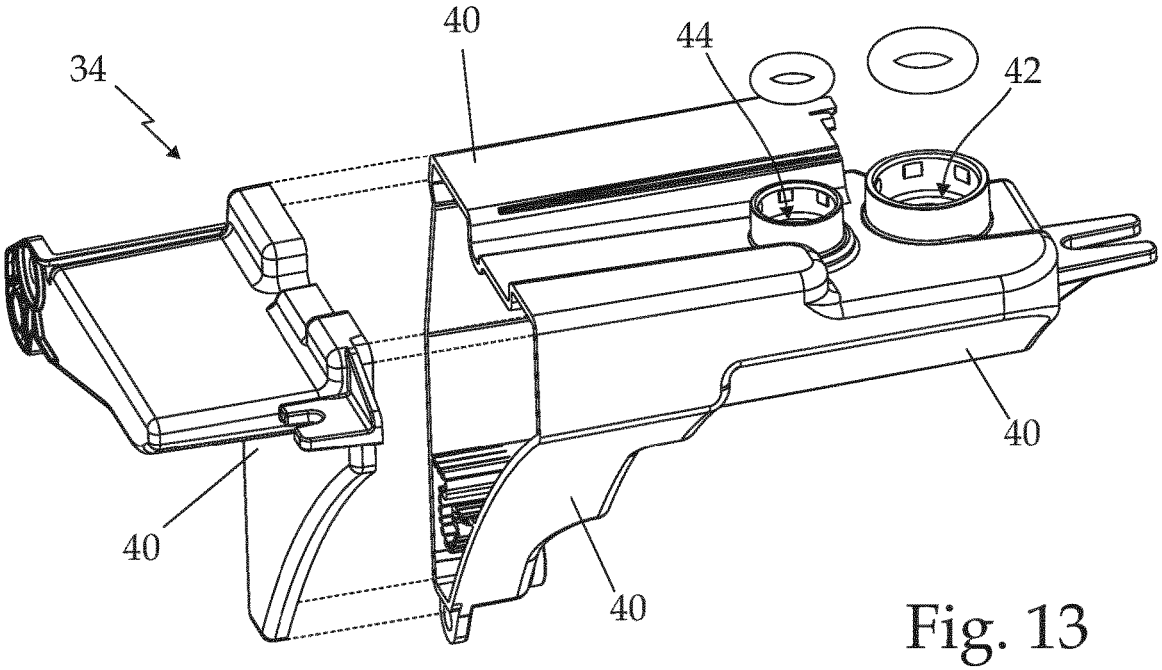
FIG. 13 is an enlarged and partially exploded perspective view of the brine tank shown in FIGS. 9 and 10, with parts removed for clarity.
Figure 14:
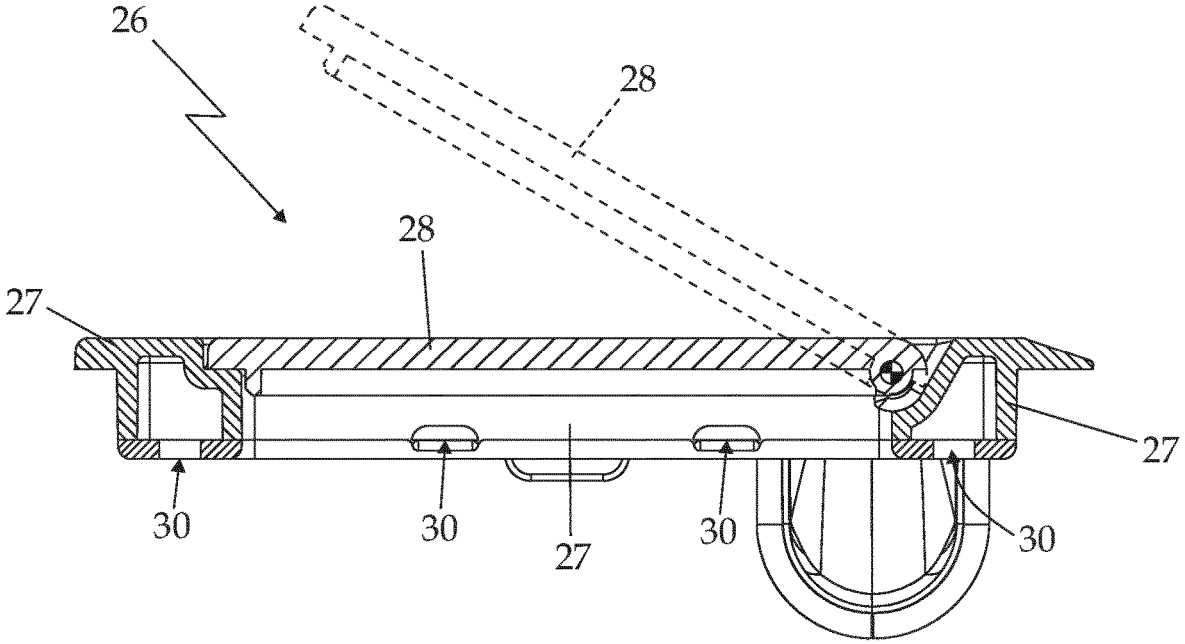
FIG. 14 is a sectioned front view of the upper lid assembly of the salt compartment of the FIG. 12 detergent drawer.

With reference to FIGS. 9 and 10, in addition to the above detergent drawer 16 preferably has, on the bottom of regeneration-agent compartment 20, a large pass-through draining opening 21 which is suitably shaped/dimensioned to allow the brine formed inside the regeneration-agent compartment 20 to freely fall on the bottom of drawer housing 18.

More in detail, with reference to FIGS. 3 and 5-10, in the example shown detergent drawer 16 preferably comprises: a single drawer-like supporting structure 23 which is preferably made in a one piece construction, and is fitted/inserted in axially sliding manner into the drawer housing 18; and a manually-sizable front panel 24 which is arranged/located on a front side of the drawer-like supporting structure 23, so as to close the entrance of drawer housing 18 when detergent drawer 16 is placed in the retracted position (see FIG. 2).

The one or more basin-shaped detergent compartments 17 and the basin-shaped regeneration-agent compartment 20 are formed directly on the drawer-like supporting structure 23 one side by side the other. The manually-sizable front panel 24, in turn, is arranged/located on a front side of the drawer-like supporting structure 23, so as to be arranged locally substantially coplanar to the front face 4 of casing 2, beside the appliance control panel 13, when detergent drawer 16 is placed in the retracted position (see FIG. 2).

In the example shown, in particular, the drawer-like supporting structure 23 of detergent drawer 16 is preferably made in a single piece, via an injection moulding process. Preferably the same applies to the manually-sizable front panel 24.

Figure 6:
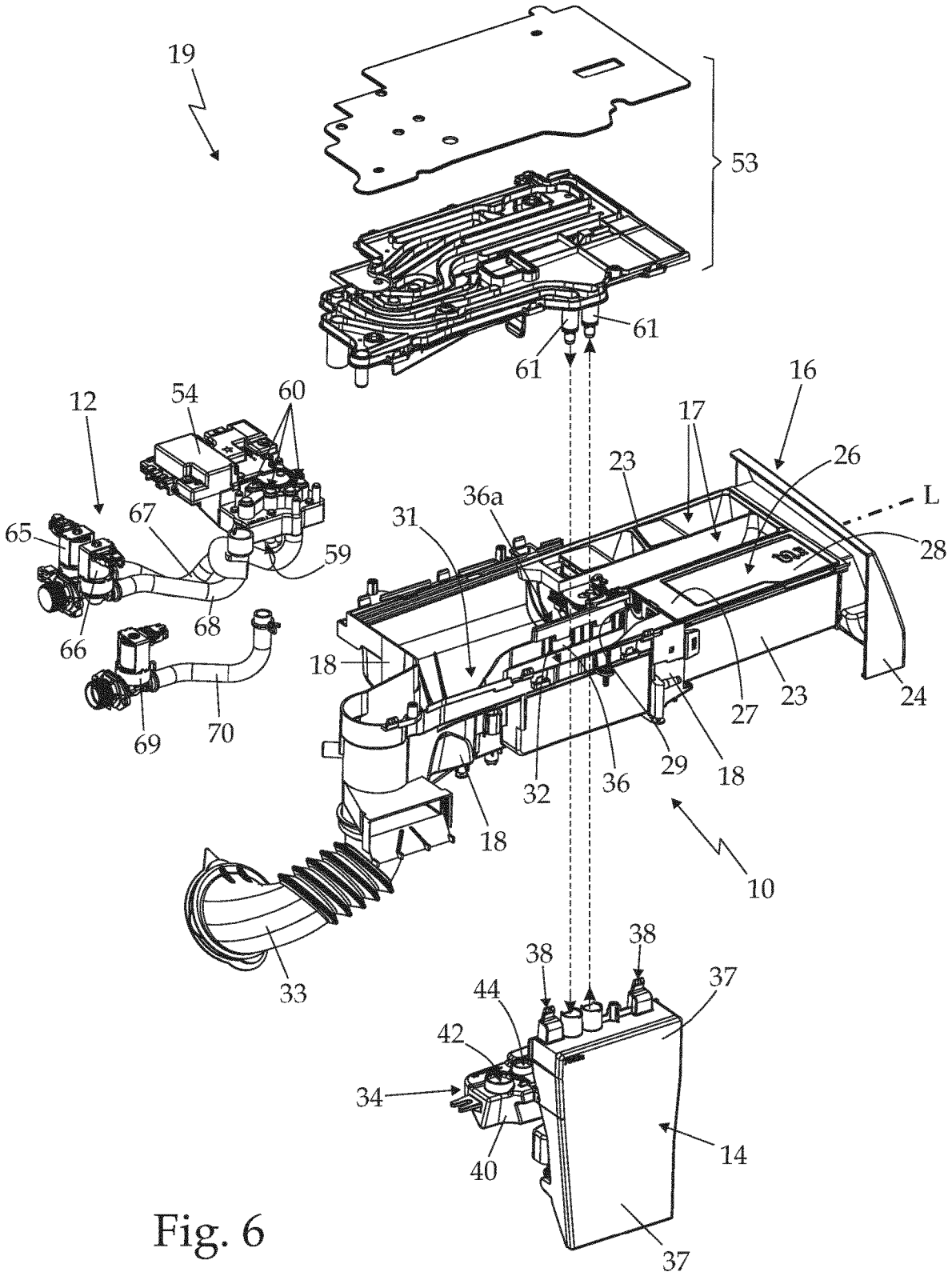
FIGS. 6 and 7 are two partially exploded perspective views of the detergent dispensing assembly shown in FIG. 4, with parts removed for clarity.

With reference to FIGS. 4, 5 and 6, the drawer flush circuit 19, in turn, is preferably additionally structured for selectively channelling, when detergent drawer 16 is placed in the retracted position, the fresh water of the water mains also into the regeneration-agent compartment 20, so as to dissolve some of the salt grains contained into the same regeneration-agent compartment 20 and form some brine.

In other words, drawer flush circuit 19 is directly connected to the fresh-water supply circuit 12 for receiving the fresh water of the water mains, and is suitably structured for selectively pouring, when the detergent drawer 16 is completely fitted/inserted into drawer housing 18, the fresh water arriving from the water mains into any one of the detergent or regeneration-agent compartments 17, 20 of detergent drawer 16.

In case of detergent compartment/s 17, the poured fresh water serves to selectively flush the contents of the detergent compartment 17 out of the same compartment 17 and down on the bottom of drawer housing 18 via siphon assembly 22. In case of regeneration-agent compartment 20, the poured fresh water serves to dissolve some salt grains contained into the regeneration-agent compartment 20 to form some brine that falls on the bottom of drawer housing 18 through opening 21.

Preferably, the internal water softening device 14 is furthermore directly connected to the drawer flush circuit 19 of detergent dispenser 7 so as to be crossed by the fresh water that is subsequently poured into the detergent compartment/s 17 of detergent drawer 16 and optionally into the regeneration-agent compartment 20, so that the hardness degree of the fresh water of the water mains poured into any one of the compartments 17, 20 of detergent drawer 16 is significantly reduced.

Figure 8:
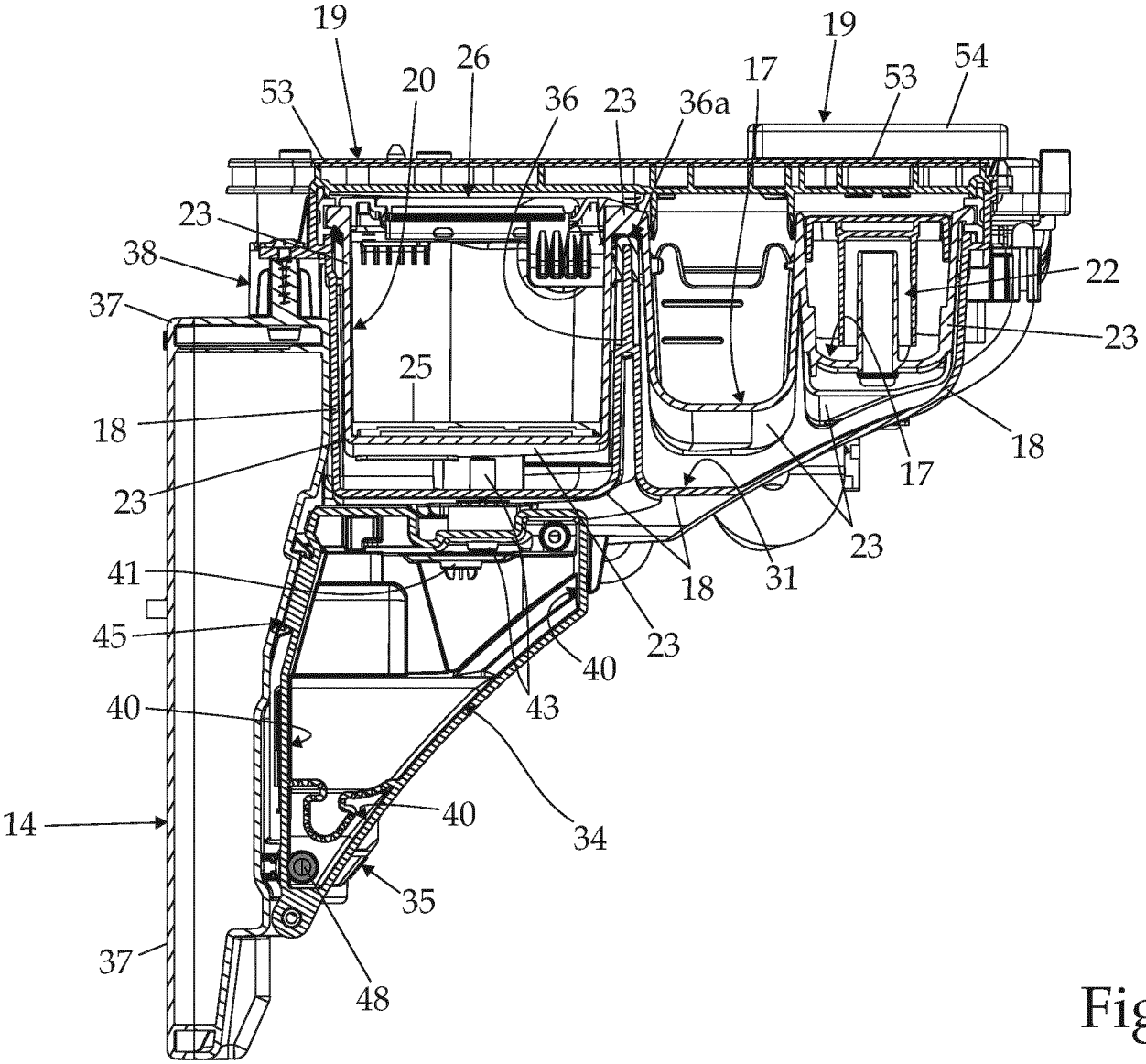
FIG. 8 is a sectioned front view of the detergent dispensing assembly shown in FIGS. 6 and 7, with parts removed for clarity.

With reference to FIGS. 8, 9 and 10, detergent drawer 16 is preferably additionally provided with a preferably manually-removable, water-permeable partitioning septum 25 which extends inside the regeneration-agent compartment 20 above the bottom of regeneration-agent compartment 20 and its large pass-through opening 21, and has a water-permeable structure designed for preventing the grains of consumable salt to come out of the regeneration-agent compartment 20 via the pass-through opening 21 and, at same time, for allowing the brine to trickle onto the bottom of the regeneration-agent compartment 20 and then freely flow by gravity towards the pass-through opening 21.

Preferably the partitioning septum 25 furthermore has a water-permeable structure suitably designed to slow down the outflow of the brine from the regeneration-agent compartment 20 via pass-through opening 21 for causing a temporarily stagnation of the water poured into the regeneration-agent compartment 20, above the same partitioning septum 25.

In other words, the water-permeable partitioning septum 25 is arranged above the pass-through opening 21 so as to completely cover the latter, and is preferably structured to allow the passage of the water/brine through the same partitioning septum 25 with a flowrate which is lower than that of the fresh water poured into the regeneration-agent compartment 20 by drawer flush circuit 19, thus to cause the stagnation of the fresh water above the partitioning septum 25.

Preferably the water-permeable partitioning septum 25 furthermore extends inside regeneration-agent compartment 20 slightly spaced from, and preferably also locally substantially parallel to, the bottom of regeneration-agent compartment 20, so as to form a thin air gap immediately above the bottom of regeneration-agent compartment 20.

In the example shown, in particular, the water-permeable partitioning septum 25 preferably consists in a rigid plate-like element 25 preferably made of plastic material, which substantially copies the shape of the bottom of regeneration-agent compartment 20, and has a microperforated structure which is suitably dimensioned to cause a prolonged stagnation of the water poured into the regeneration-agent compartment 20 above the partitioning septum 25.

More in detail, the central portion of plate-like element 25 is preferably provided with a plenty of substantially evenly distributed, transversal pass-through microholes or microslots each preferably having a cross-sectional area lower that 3 $mm^2$ (square millimetres), so as to allow the flow/passage of the brine/water through 10 the partitioning septum 25 with a flowrate preferably ranging between 0.4 and 1 litre/min (litre per minute). The flowrate of the fresh water poured into the regeneration-agent compartment 20 instead preferably ranges between 5 and 8 litre/min (litre per minute).

With reference to FIGS. 3, 5, 6, 9, 10 and 14, detergent drawer 16 preferably, though not necessarily, additionally comprises a manually openable, upper lid assembly 26 which is firmly fitted on the drawer-like supporting structure 23, on top of regeneration-agent compartment 20, and is structured to selectively close/cover the upper mouth of regeneration-agent compartment 20, preferably so as to almost completely cover the upper mouth of regeneration-agent compartment 20. Furthermore the upper lid assembly 26 is additionally structured so as to be able to receive, from drawer flush circuit 19 and at least when detergent drawer 16 is placed in the retracted position, a flow of fresh water of the water mains and to channel said water into the beneath-located regeneration-agent compartment 20, preferably while spreading out the same fresh water inside the regeneration-agent compartment 20.

In other words, the upper lid assembly 26 is preferably provided with a water inlet which is faced to the outside of regeneration-agent compartment 20 and is structured to allow the fresh water to enter into the same upper lid assembly 26, and with one or more water outlets which are faced to the inside of regeneration-agent compartment 20, fluidically communicate with the water inlet and are finally suitably structured to allow the water entering into the upper lid assembly 26 through the water inlet to come out of the lid assembly 26 and fall into the regeneration-agent compartment 20.

The drawer flush circuit 19, in turn, is preferably structured to selectively channel, when detergent drawer 16 is placed in the retracted position, a flow of fresh water of the water mains towards the water inlet of the upper lid assembly 26.

In other words, drawer flush circuit 19 is preferably structured to selectively channel, when detergent drawer 16 is placed in the retracted position, the fresh water of the water mains into the water inlet of the upper lid assembly 26 which, in turn, is structured to distribute the fresh water arriving from the drawer flush circuit 19 into the regeneration-agent compartment 20.

In addition to the above, in the example shown the water inlet of the upper lid assembly 26 is furthermore preferably structured to couple, when the detergent drawer 16 is placed in the retracted position, in a stable, though easy detachable manner, with the drawer flush circuit 19 for receiving the fresh water of the water mains directly from the drawer flush circuit 19, and to sprinkle/distribute said fresh water into the regeneration-agent compartment 20.

With reference to FIGS. 6-14, in the example shown, in particular, the upper lid assembly 26 preferably comprises a plate-like element 27 which is structured to rigidly fit into the upper rim of regeneration-agent compartment 20 to substantially completely cover/close the upper mouth of the regeneration-agent compartment 20; and a manually-movable trapdoor 28 which is arranged to close a preferably substantially rectangular-shaped, large pass-through opening which is preferably formed roughly at centre of plate-like element 27, and which is suitably shaped/dimensioned to allow the user to easily manually pour the consumable salt (NaCl) or other regeneration agent into the regeneration-agent compartment 20.

Furthermore plate-like element 27 is preferably provided with a water inlet 29 which is suitably structured to water-tight couple with the drawer flush circuit 19 when detergent drawer 16 is placed in the retracted position, and with one or more water-delivery portions 30 which are arranged on the lower face of plate-like element 27, preferably all around the central pass-through opening closed by trapdoor 28, directly communicate with the water inlet 29 via one or more internal channels, and are suitably structured to allow the outflow of the fresh water from the plate-like element 27.

Preferably these water-delivery portions 30 are furthermore suitably shaped/structured to pour a shower of water droplets by gravity into the regeneration-agent compartment 20.

Drawer flush circuit 19, in turn, is preferably structured to hydraulically couple, when detergent drawer 16 is placed in the retracted position, with the water inlet 29 of the plate-like element 27, so as to selectively channel the fresh water of the water mains also into the upper lid assembly 26 which, in turn, distributes said water into the regeneration-agent compartment 20, so as to dissolve some of the salt contained into the regeneration-agent compartment 20 and form the brine that falls on the bottom of drawer housing 18.

In other words, drawer flush circuit 19 is directly connected to the fresh-water supply circuit 12 for receiving the fresh water of the water mains, and is suitably structured for selectively and alternatively channelling, when the detergent drawer 16 is completely fitted/inserted into drawer housing 18, the fresh water arriving from fresh-water supply circuit 12 into any one of the detergent compartments 17, or into the water inlet 29 of the upper lid assembly 26.

With reference to FIGS. 3, 6, and 8, the bottom of drawer housing 18 in turn is preferably divided into two separated and substantially basin-shaped, bottom portions 31 and 32 which are vertically aligned, when detergent drawer 16 is placed in the retracted position, respectively to all detergent compartments 17 and to the regeneration-agent compartment 20.

More in detail, in the example shown the bottom of drawer housing 18 is preferably divided into two separated and substantially basin-shaped bottom portions 31 and 32, which are arranged side by side to one another transversally to the displacement direction d of detergent drawer 16 inside drawer housing 18, i.e. transversally to the longitudinal axis L of drawer housing 18, so as to be vertically aligned, when detergent drawer 16 is placed in the retracted position, one underneath the one or more detergent compartments 17, and the other underneath the regeneration-agent compartment 20.

The basin-shaped bottom portion 31 vertically aligned to the one or more detergent compartments 17 is structured to receive the mixture of fresh water and detergent, softener or other washing agent falling down from any one of the detergent compartments 17 of detergent drawer 16 via the corresponding siphon assembly 22, and communicates with the inside of washing tub 3 preferably via a delivery duct 33 that branches off from the basin-shaped bottom portion 31 of drawer housing 18 and ends directly into the beneath-located washing tub 3, so as to allow the mixture of water and detergent, softener or other washing agent to flow by gravity directly into the washing tub 3.

With reference to FIGS. 4-8 and 11-13, the basin-shaped bottom portion 32 vertically aligned to the regeneration-agent compartment 20, in turn, is structured for receiving the brine dripping/falling down from the regeneration-agent compartment 20 via the pass-through opening 21, and fluidically communicates with a discrete brine container 34 which is located underneath the drawer housing 18, preferably adjoining the bottom of drawer housing 18 and preferably vertically aligned to the basin-shaped bottom portion 32, so as to allow the brine to freely flow by gravity from the basin-shaped bottom portion 32 directly into brine container 34.

Brine container 34, in turn, is suitably dimensioned to catch and contain an amount of brine greater than 100 ml (millilitres), and directly communicates with the water softening device 14 via a small electric pump assembly 35 which is capable of selectively pumping the brine (i.e. the mixture of water and salt) from brine container 34 to water softening device 14.

In the example shown, in particular, the brine container 34 is preferably dimensioned to contain a maximum amount of preferably rounding up to the whole amount of brine to be pumped into the internal water softening device 14 for regenerating the ion-exchange resins located inside the same water softening device 14.

As an alternative the brine container 34 may be dimensioned to contain a maximum amount of preferably rounding up to a submultiple of the whole amount of brine to be pumped into the water softening device 14 for regenerating the ion-exchange resins located inside the same water softening device 14.

Pump assembly 35, in turn, preferably comprises an electrically-powered volumetric pump.

With particular reference to FIGS. 3, 6 and 8, drawer housing 18 preferably furthermore comprises a substantially vertical, partitioning wall 36 that protrudes upwards from the bottom of drawer housing 18 while remaining locally substantially parallel to the displacement direction d of detergent drawer 16, i.e. parallel to the longitudinal axis L of drawer housing 18, and the basin-shaped bottom portions 31 and 32 of drawer housing 18 are arranged on opposite sides of partitioning wall 36.

In other words the vertical partitioning wall 36 is arranged between the two basin-shaped bottom portions 31 and 32 of drawer housing 18.

Detergent drawer 16, in turn, is preferably arranged astride the partitioning wall 36 so that the one or more detergent compartments 17 and the regeneration-agent compartment 20 are arranged on opposite sides of same partitioning wall 36.

More in detail, with reference to FIGS. 6 and 8, the bottom portion of the drawer-like supporting structure 23 of detergent drawer 16 is preferably provided with a rectilinear groove extending parallel to the longitudinal axis L of detergent drawer 16, i.e. parallel to the displacement direction d of detergent drawer 16 inside drawer housing 18, between the one or more detergent compartments 17 and the regeneration-agent compartment 20, and the partitioning wall 36 of drawer housing 18 protrudes from the bottom of drawer housing 18 and extends upwards into said rectilinear groove.

Preferably the drawer-like supporting structure 23 of detergent drawer 16 is furthermore structured to abut in axially sliding manner on the straight upper crest line 36*a* of partitioning wall 36, so that the detergent drawer 16 rests in abutment also onto the same partitioning wall 36.

In other words, with reference to FIGS. 6 and 11, in the example shown the drawer-like supporting structure 23 of detergent drawer 16 is preferably engaged/coupled in axially sliding manner to the drawer housing 18 via two rectilinear runners or groves that extend on the two reciprocally-faced sidewalls of drawer housing 18 locally substantially parallel to the displacement direction d of detergent drawer 16, i.e. parallel to the longitudinal axis L of detergent drawer 16 and drawer housing 18. Furthermore the drawer-like supporting structure 23 of detergent drawer 16 is additionally centrally coupled in axially sliding manner to drawer housing 18 at the upper crest line 36*a* of partitioning wall 36.

With reference to FIGS. 6-13, the brine container 34, in turn, preferably consists in a discrete modular member which is completely distinct and separated from drawer housing 18, and is provided with first mechanical coupling means structured for allowing the rigid fastening and/or fluidical connection of the same discrete modular member to the bottom of drawer housing 18, so as to directly communicate with the basin-shaped bottom portion 32 of drawer housing 18 for receiving by gravity the brine that arrives on said basin-shaped bottom portion 32.

Preferably, said discrete modular member is moreover provided with second mechanical coupling means structured for allowing the rigid fastening and/or fluidical connection of the same discrete modular member to the water softening device 14.

In addition to the above, brine container 34 and water softening device 14 are altogether structured so as to form, preferably also together with pump assembly 35, an intermediate discrete modular assembly which is subsequently rigidly attached to drawer housing 18.

Preferably brine container 34 is furthermore structured to fit/couple with the water softening device 14 with the interposition of the pump assembly 35 which moreover preferably remains unmovably trapped between the water softening device 14 and the same brine container 34.

With reference to FIGS. 6-13, in the example shown, in particular, the water softening device 14 preferably comprises a substantially plate-like, discrete modular cartridge 37 which is provided with a water inlet and a water outlet, and is filled up with a given amount of ion-exchange resins capable of retaining the calcium and magnesium ions (Ca++ and Mg++) dissolved in the water flowing through the same modular cartridge. This discrete modular cartridge 37 is preferably furthermore rigidly attached to a sidewall of drawer housing 18 preferably via releasable snap-on locking means 38, so as to cantilevered extend downwards beyond the bottom of drawer housing 18 preferably while remaining locally substantially parallel and tangent to a vertical sidewall of the outer casing 2.

Brine container 34, in turn, preferably comprises: a small unpressurized tank 40 dimensioned to contain an amount of brine preferably greater than 100 ml (millilitres); and optionally also sensor means (not shown) capable of detecting the level of the water stored inside tank 40 and/or the salinity degree of the water stored into tank 40.

More in detail, tank 40 is completely distinct and separated from drawer housing 18, and is provided with one or more coupling portions structured for allowing rigid fastening and fluidical connection of tank 40 to the drawer housing 18, so that the inside of tank 40 directly communicates with the basin-shaped bottom portion 32 of drawer housing 18 for receiving the brine arriving on the bottom of drawer housing 18.

Preferably tank 40 is furthermore dimensioned to contain a maximum amount of brine rounding up the whole amount of brine to be pumped into the water softening device 14, or better into the ion-exchange resins discrete modular cartridge 37, for performing the whole regeneration process of the ion-exchange resins stored into the water softening device 14.

Obviously as an alternative, tank 40 could be dimensioned to contain a maximum amount of brine rounding up a submultiple of the whole amount of brine to be pumped into water softening device 14, or better into the ion-exchange resins discrete modular cartridge 37, for performing the whole regeneration process of the ion-exchange resins stored into the water softening device 14.

In addition to the above, tank 40 is preferably furthermore provided with one or more coupling portions structured for allowing rigid fastening and/or fluidical connection of tank 40 to the water softening device 14, or better the ion-exchange-resins container 37 of water softening device 14.

More in detail, in the example shown tank 40 is preferably rigidly fastened, preferably together with pump assembly 35, to the major face of the plate-like, ion-exchange resins cartridge 37 turned towards the bottom of drawer housing 18, so as to form, together with the ion-exchange resins cartridge 37 and optionally with pump assembly 35, a intermediate discrete modular assembly which, in turn, is subsequently rigidly fastened to drawer housing 18, so as to arrange the tank 40 immediately underneath the bottom of drawer housing 18, in fluidic communication with the basin-shaped bottom portion 32 of drawer housing 18.

Preferably, ion-exchange-resins container 37 of water softening device 14, i.e. ion-exchange resins cartridge 37, and tank 40 are furthermore altogether structured to form, when coupled to one another and in between themselves, a receiving seat dimensioned to accommodate pump assembly 35. This receiving seat is preferably moreover designed so that pump assembly 35 remains unmovably trapped, after tank 40 is firmly attached to water softening device 14, between water softening device 14 and tank 40.

With reference to FIGS. 6-16, in the example shown, in particular, tank 40 is preferably dimensioned to contain an amount of brine ranging between 100 and 600 ml (millilitres), and preferably directly communicates with the basin-shaped bottom portion 32 of drawer housing 18 via a vertical pipe-extension 41 that protrudes downwards from the bottom of drawer housing 18 and fits into a complementary brine inlet opening 42 formed on top wall of tank 40 preferably in a substantially airtight and/or watertight manner.

With reference to FIGS. 7, 8, 11, 15 and 16, preferably tank 40 furthermore fluidically communicates with the inside of drawer housing 18 via a second vertical pipe-extension 43 that protrudes downwards from the bottom of drawer housing 18 and fits into a complementary air vent opening 44 formed on top wall of tank 40, beside brine inlet opening 42, preferably in a substantially airtight and/or watertight manner.

Preferably this vertical pipe-extension 43 furthermore protrudes upwards into drawer housing 18 within the perimeter of the basin-shaped bottom portion 32 of drawer housing 18, so as to arrange its upper mouth at a given high from the basin-shaped bottom portion 32 and thus prevent the brine from freely fall into tank 40.

As a result, the brine flows into tank 40 solely via the vertical pipe-extension 41, and the vertical pipe-extension 43 allows free ventilation of tank 40 and the selective overflow into tank 40 of the exceeding brine that may stagnate on the bottom basin-shaped bottom portion 32.

In addition to the above, preferably tank 40 is furthermore rigidly fastened to the bottom of drawer housing 18 by means of one or more anchoring screws.

In other words, brine container 34 is rigidly fastened to the bottom of drawer housing 18 via a detachable plug-in mechanical coupling, and optionally also via one or more anchoring screws.

With reference to FIGS. 6, 7, 8, 11 and 12, tank 40 is preferably moreover rigidly attached to the water softening device 14, or better to the ion-exchange-resins container 37 of internal water softening device 14, via a second detachable plug-in mechanical coupling.

More in detail, in the example shown tank 40 is preferably rigidly fastened to the plate-like modular cartridge 37 via a sliding dovetail joint 45 which is located on the major face of modular cartridge 37 turned towards the bottom of drawer housing 18, and preferably extends locally substantially parallel to the bottom of drawer housing 18, i.e. preferably extends substantially horizontally on the major face of the plate-like, ion-exchange resins modular cartridge 37. Furthermore tank 40 is preferably additionally rigidly fastened to the outer casing of the ion-exchange resins modular cartridge 37 via one or more anchoring screws 45*b*.

With reference to FIGS. 11 and 12, preferably the outer casing of the ion-exchange resins modular cartridge 37 is furthermore provided with a small projection 46 that protrudes from the major face of the plate-like, ion-exchange resins modular cartridge 37 spaced apart beside tank 40, in a direction parallel to the fitting direction of dovetail joint 45. Pump assembly 35 in turn rests on the major face of the plate-like, ion-exchange resins modular cartridge 37 locally substantially tangent to the outer casing of modular cartridge 37, between tank 40 and projection 46, so as to remain unmovably trapped between tank 40 and projection 46 when tank 40 is fastened to water softening device 14.

With reference to FIGS. 11 and 12, pump assembly 35, instead, preferably basically comprises an electrically-powered membrane pump 47 having the suction of the pump fluidically connected to tank 40 preferably via a first duckbill valve 48, so as to be able to suck the brine from the inside of tank 40, and the delivery of the pump fluidically connected, at projection 46, to the water softening device 14 preferably via a second duckbill valve 49, so as to be able to feed the brine into the water softening device 14.

With reference to FIGS. 4-8 and 17, the drawer flush circuit 19 of detergent dispenser 10, in turn, preferably comprises:

a plate-like water delivery member 53 which is suitably structured to form the upper lid of the substantially basin-shaped drawer housing 18, so as to be located immediately above the detergent drawer 16 when the latter is placed in the retracted position, i.e. when the latter is completely inserted/recessed into drawer housing 18, and is provided with a number of water-delivery portions each suitably structured to allow the outflow of water from the plate-like water delivery member 53 towards the beneath located detergent drawer 16; and an electrically-operated, flow-diverter 54 which is connected to fresh-water supply circuit 12 and/or to water softening device 14 for receiving unsoftened or softened fresh water, and is suitably structured to selectively channel the unsoftened fresh water arriving from fresh-water supply circuit 12 or the softened fresh water arriving from water softening device 14, towards any one of the water-delivery portions of the plate-like water delivery member 53.

More in detail, the plate-like water delivery member 53 is provided, on the side directly faced to the inside of drawer housing 18, with a group of first water-delivery portions 55 which are locally substantially vertically aligned, when detergent drawer 16 is placed in the retracted position, each to a respective detergent compartment 17 of detergent drawer 16, and are each suitably structured to allow the outflow of the fresh water from the plate-like water delivery member 53 towards the beneath-located detergent compartment 17.

Figure 17:
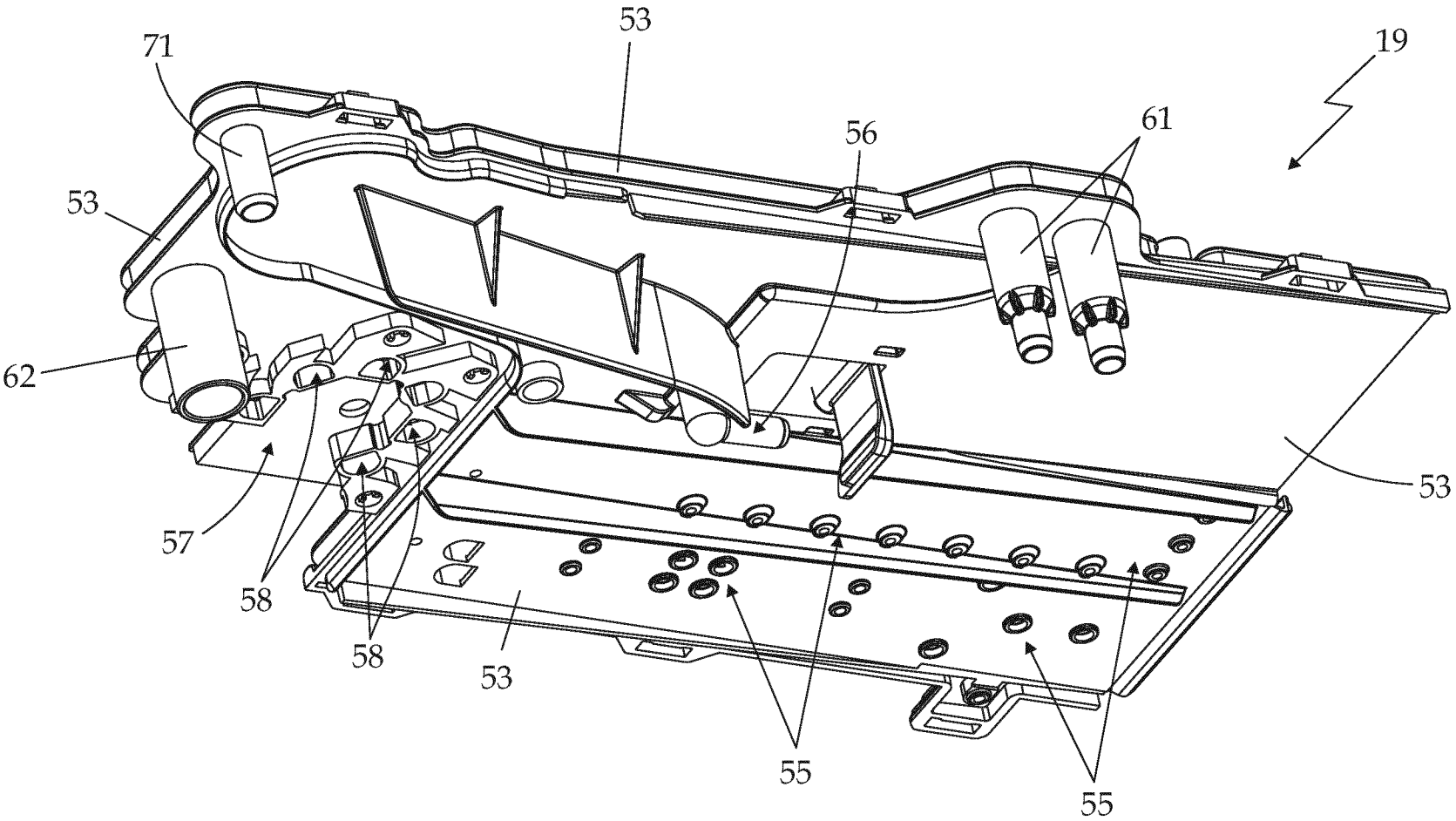

With reference to FIG. 17, in the example shown, in particular, each water-delivery portion 55 is preferably structured to pour by gravity a shower of water droplets directly into the beneath-located detergent compartment 17 of detergent drawer 16.

Preferably the plate-like water delivery member 53 is furthermore provided, on the side directly faced to the inside of drawer housing 18, with a second water-delivery portion 56 which is locally substantially vertically aligned, when detergent drawer 16 is placed in the retracted position, to the regeneration-agent compartment 20 of detergent drawer 16, and is suitably structured to allow the outflow of the fresh water from the plate-like water delivery member 53 towards the beneath-located regeneration-agent compartment 20.

Figure 15:
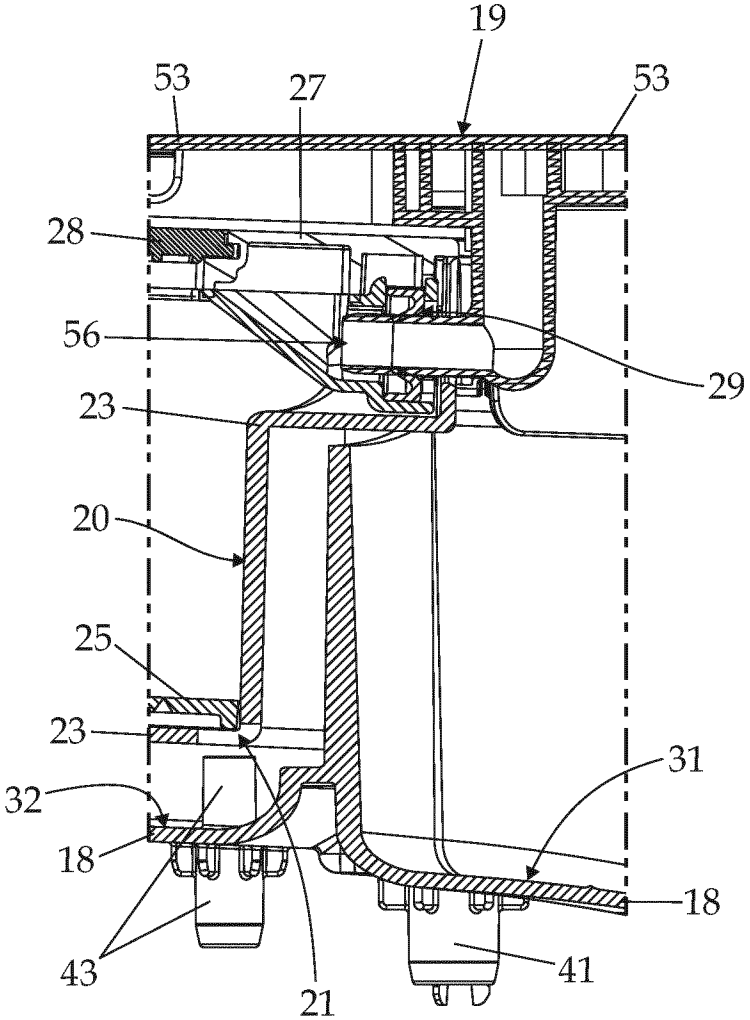
FIG. 15 is a first sectioned side view of a portion of the detergent dispensing assembly shown in FIGS. 6 and 7, with parts removed for clarity.

More in detail, with reference to FIGS. 15 and 17, in the example shown the water-delivery portion 56 preferably consists in a male or female hydraulic connector which is suitably structured to couple, when detergent drawer 16 is placed in the retracted position, in detachable manner with a complementary second hydraulic connector incorporated into the water inlet 29 of the upper lid assembly 26, so as to put the upper lid assembly 26 in fluid communication with the plate-like water delivery member 53.

With reference to FIGS. 6 and 17, the electrically-operated, flow-diverter 54, in turn, preferably consists in a discrete, electrically-operated, flow-diverter module which is firmly attached outside of plate-like water delivery member 53, at a coupling socket 57 preferably realized on one of the two major faces of the plate-like water delivery member 53. This discrete, electrically-operated, flow-diverter module 54 is preferably furthermore hydraulically connected both to the fresh-water supply circuit 12 for directly receiving a flow of unsoftened fresh water, and to the water softening device 14 for directly receiving a flow of softened fresh water.

More in detail, with particular reference to FIGS. 6 and 17, the plate-like water delivery member 53 is provided with a number of water inlets 58 which are located at coupling socket 57 and separately communicate each with a respective water-delivery portion 55, 56 of water delivery member 53.

The electrically-operated, flow-diverter module 54, in turn, has a main water inlet 59 which directly communicates with the water softening device 14 for directly receiving softened fresh water, and preferably also with the fresh-water supply circuit 12 for also directly receiving unsoftened fresh water; and a number of main water outlets 60 which are located, preferably one side by side the other, at the interface portion of flow-diverter module 54 suited to couple with coupling socket 57, and are each structured to water-tight couple/connect, at coupling socket 57, with a respective water inlet 58 of the plate-like water delivery member 53, preferably with the interposition of a corresponding annular sealing gasket.

Preferably the electrically-operated, flow-diverter module 54 furthermore internally accommodates a rotatable flow diverter (not shown) which is capable of channelling, according to its angular position, the water entering into flow-diverter module 54 via the water inlet 59 towards any one of the water outlets 60 of the flow-diverter module 54.

The electrically-operated, flow-diverter module 54 is therefore internally structured to selectively channel, towards any one of its water outlets 60, the water entering into the flow-diverter module 54 via the main water inlet 59, so as to be able to selectively channel a flow of softened or unsoftened fresh water into any one of the water inlets 58 of the plate-like water delivery member 53.

Figure 16:
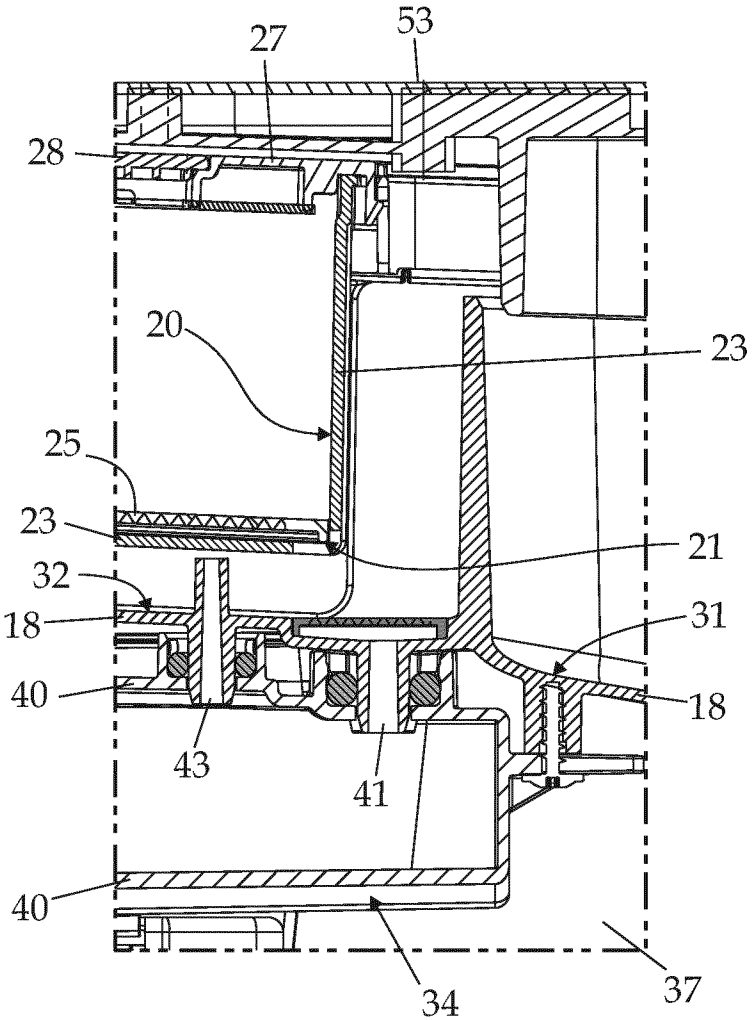
FIG. 16 is a second sectioned side view of a portion of the detergent dispensing assembly shown in FIGS. 6 and 7, with parts removed for clarity.

More in detail, with reference to FIGS. 6, 8 and 16, in the example shown the plate-like water delivery member 53 is preferably provided with a number of internal water channels each of which separately begins at coupling socket 57, and extends inside the body of water delivery member 53 up to reach a corresponding water-delivery portion 55 or 56 of plate-like water delivery member 53. Each water outlet 60 of flow-diverter module 54, in turn, is substantially watertight coupled, at coupling socket 57, with the mouth of a corresponding internal water channel of the plate-like water delivery member 53.

In addition to the above, the flow-diverter module 54 preferably furthermore comprises an electrically-operated motor assembly (not shown) which is mechanically connected to the rotatable flow diverter for controlling the angular position of the flow diverter, and optionally also an electronic control unit which is structured to directly power and control the electrically-operated motor assembly according to electric signals arriving from the main electronic central control unit (not shown) of the laundry washing machine 1.

With reference to FIGS. 6 and 17, the internal water softening device 14, or better the ion-exchange-resins container 37 of water softening device 14, in turn is preferably fluidically connected directly to the plate-like water delivery member 53 of drawer flush circuit 19, so as to be crossed by the fresh water that is subsequently poured into any one of the detergent compartments 17 and optionally also into the regeneration-agent compartment 20, so that the hardness degree of the tap water arriving from fresh-water main supply circuit 12 is reduced.

More in detail, in the example shown the water inlet and the water outlet of the ion-exchange-resins container 37 of water softening device 14, i.e. the plate-like, ion-exchange resins modular cartridge 37, are preferably fluidically connected directly to the plate-like water delivery member 53 by means of two hydraulic connectors 61 that protrude from the lower side of the plate-like water delivery member 53, i.e. from the major face of plate-like water delivery member 53 provided with coupling socket 57 and water-delivery portions 55 and 56.

With reference to FIG. 17, the hydraulic connector 61 suited to couple with the water inlet of water softening device 14 directly communicates with a pipe-fitting 62 which protrudes from plate-like water delivery member 53, and is structured to watertight couple with the fresh-water supply circuit 12 bypassing the flow-diverter module 54. The hydraulic connector 61 suited to couple with the water outlet of water softening device 14, in turn, directly communicates, at coupling socket 57, with the main water inlet 59 of flow-diverter module 54.

Figure 7:
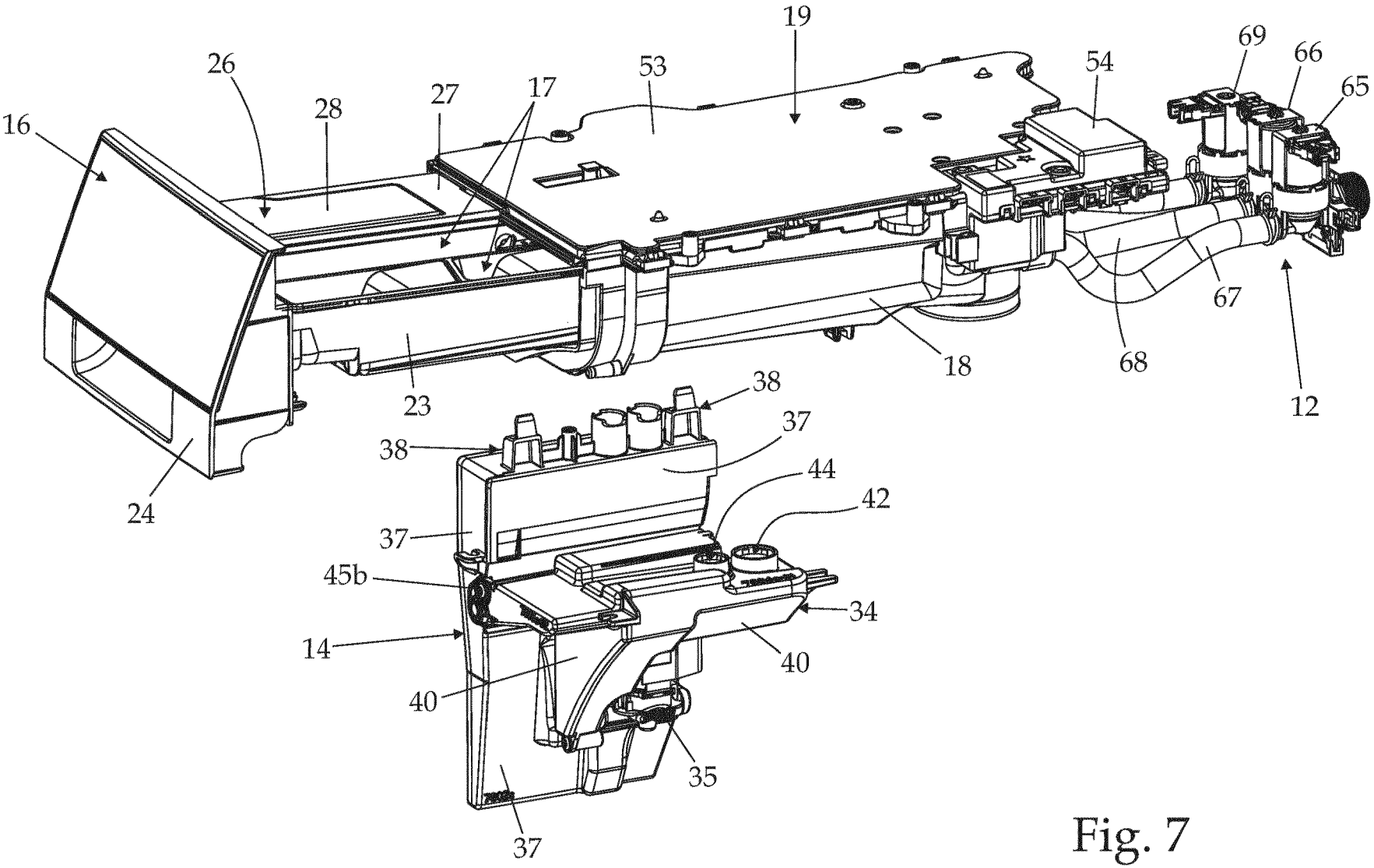

With particular reference to FIGS. 6 and 7, the fresh-water supply circuit 12 of laundry washing machine 1, in turn, preferably comprises two independent electrically-operated on-off valves 65 and 66, each separately connectable to the water mains. The electrically-operated on-off valve 65 is directly connected to the main water inlet 59 of flow-diverter module 54 via a first connecting hosepipe or manifold 67. The electrically-operated on-off valve 66 is directly connected to the pipe-fitting 62 of plate-like water delivery member 53 via a second connecting hosepipe or manifold 68.

In addition to the above, with reference to FIGS. 6 and 17, in the example shown the fresh-water supply circuit 12 preferably finally comprises a further independent electrically-operated, on-off valve 69 which is separately connectable to a source of hot water (namely the hot branch of the piping, fittings, and fixtures involved in the distribution and use of hot water in the domestic building), and is directly connected to a second pipe-fitting 71 of plate-like water delivery member 53 via a third connecting hosepipe or manifold 70. This second pipe-fitting 71 directly communicates, at coupling socket 57, with the main water inlet 59 of flow-diverter module 54, thus to channel a flow of hot, unsoftened fresh water towards the main water inlet 59 of flow-diverter module 54.

As an alternative, pipe-fitting 71 of plate-like water delivery member 53 may directly communicate with the water inlet of water softening device 14 or, better, with the hydraulic connector 61 suited to couple with the water inlet of the water softening device 14, thus to channel a flow of hot, unsoftened fresh water towards the water inlet of water softening device 14.

General operation of the laundry washing machine 1 is similar to that of the front loading washing machine disclosed in ELECTROLUX European patent No. 2554736, the only exception being that the partitioning septum 25 with micro-perforated structure causes an extremely slow outflow of the brine (i.e. salt water) from the regeneration-agent compartment 20.

More in detail, the water-permeable partitioning septum 25 allows the passage of the water/brine through the same partitioning septum 25 with a flowrate which is significantly lower than that of the fresh water poured into the regeneration-agent compartment 20 by drawer flush circuit 19, thus the softened or unsoftened fresh water poured into the regeneration-agent compartment 20 by the drawer flush circuit 19 temporarily accumulates above the partitioning septum 25.

As a consequence, the partitioning septum 25 causes a temporary increase of the level of water above the same partitioning septum 25.

More precisely, the partitioning septum 25 causes a quick increase of the level of water inside the regeneration-agent compartment 20, up to a maximum value above the partitioning septum 25, and then a slow lowering of the level of water down to the high of the same partitioning septum 25.

After slowly passing/flowing through the partitioning septum 25, the brine formed into the regeneration-agent compartment 20, above the partitioning septum 25, reaches the pass-through opening 21 and then trickles onto the basin-shaped bottom portion 32 of drawer housing 18.

After reaching the basin-shaped bottom portion 32, the brine quickly falls into brine tank 40 via the vertical pipe-extension 41 and accumulates into tank 40, thus after a few minutes all the brine formed into the regeneration-agent compartment 20 has moved into brine tank 40.

At the end of the temporary stagnation of the water, therefore the regeneration-agent compartment 20 remains empty of brine.

Assuming now that the overall amount of brine to be pumped into the water softening device 14, or better into the closed container 37 filled with the ion-exchange resins capable of retaining the calcium and magnesium ions (Ca++ and Mg++) dissolved in water, for performing the whole regeneration process of the ion-exchange resins is equal, for example, to 500 $cm^3$ (cubic centimeters) and in that tank 40 is dimensioned to contain a maximum amount of brine equal, for example, to 520 $cm^3$ (cubic centimeters), the laundry washing machine 1 operates as follows.

When regeneration of the ion-exchange resins is to be performed, the central control unit of laundry washing machine 1 operates the flow-diverter module 54 so as to channel the softened or unsoftened fresh water entering into the detergent dispenser 10 towards the regeneration-agent compartment 20, and then opens for a short time either the on-off valve 65 or the on-off valve 66 of the fresh-water supply circuit 12, so as to pour a given amount of fresh water, for example 250 $cm^3$ (cubic centimetres), into the regeneration-agent compartment 20.

Due to the presence of water-permeable partitioning septum 25, the softened or unsoftened fresh water poured into the regeneration-agent compartment 20 temporarily accumulates above the partitioning septum 25 wherein can dissolve a great amount of salt grains and form the brine.

The brine formed into the regeneration-agent compartment 20, above the partitioning septum 25, slowly passed across the partitioning septum 25 and then trickles into the basin-shaped bottom portion 32 of drawer housing 18. From basin-shaped bottom portion 32, the 250 $cm^3$ (cubic centimetres) of brine then quickly falls into tank 40 wherein accumulates.

Then, if tank 40 has room for other brine, the central control unit of laundry washing machine 1 opens again for a short time either the on-off valve 65 or the on-off valve 66 of fresh-water supply circuit 12, so as to pour some more fresh water, for example once again 250 $cm^3$ (cubic centimeters), into the regeneration-agent compartment 20 to form a 250 $cm^3$ of brine that, again, slowly moves into tank 40.

When tank 40 is completely full of brine, i.e. contains an amount of brine sufficient for performing the whole regeneration process of the ion-exchange resins stored into the water softening device 14, the central control unit of laundry washing machine 1 activates electric pump assembly 35 to move at a time the whole brine from tank 40 to water softening device 14, so as to fill up the ion-exchange-resins container 37.

The advantages resulting from the presence of brine container 34 underneath the drawer casing 18 are remarkable.

First of all, the connection between the suction of pump assembly 35 and the regeneration-agent compartment 20 is greatly simplified with the costs savings that this entails.

Furthermore the use of a brine container 34 having a maximum storage capacity roughly equal to the overall volume of brine to be pumped into the water softening device 14 for performing the whole regeneration process of the ion-exchange resins, allows a much more precise control of the amount of brine pumped into the water softening device 14 for performing the regeneration process of the ion-exchange resins.

Clearly, changes may be made to the laundry washing machine 1 without, however, departing from the scope of the present invention.

For example, according to an alternative embodiment the detergent drawer 16 may have, in place of the large pass-through draining opening 21, a siphon assembly which is located inside the regeneration-agent compartment 20 and is suitably structured/dimensioned to selectively channel the brine formed inside the regeneration-agent compartment 20 onto the bottom of drawer housing 18.

Furthermore, according to a less sophisticated embodiment, the electrically-operated, flow-diverter 54 of drawer flush circuit 19 may be incorporated into the plate-like water delivery member 53 as disclosed in EP2562303.

According to a not-shown alternative embodiment, moreover the one or more detergent compartments 17 of detergent drawer 16 may be dimensioned to contain a given amount of detergent, softener or other washing agent sufficient for performing a number of washing cycles. Detergent drawer 16, furthermore, may optionally comprise, for each detergent compartment 17, a respective electrically-powered detergent feeding pump which is structured to selectively suck the dose of detergent, softener or other washing agent necessary to perform a washing cycle from the detergent compartment 17 and pump said dose of detergent, softener or other washing agent on the basin-shaped bottom portion 31 of drawer housing 18.

Figure 18:
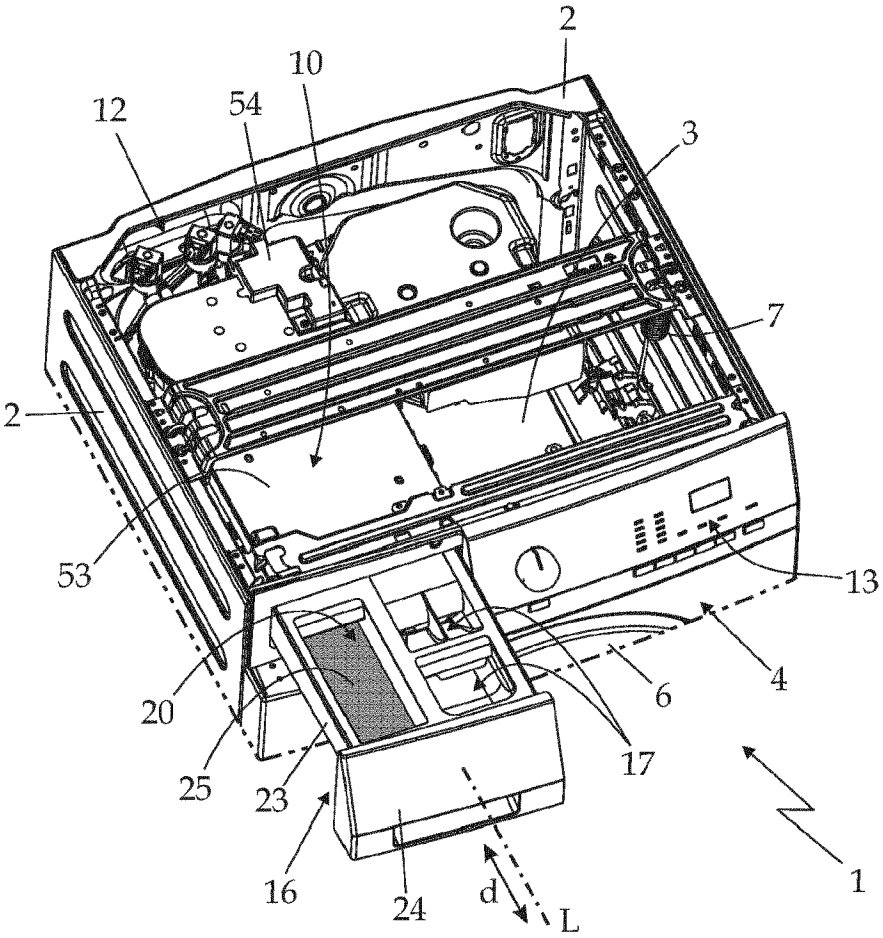

With reference to FIG. 18, in a less sophisticated embodiment the detergent drawer 16 lacks the manually openable, upper lid assembly 26, and the water-delivery portion 56 associated to the regeneration-agent compartment 20 is arranged on the plate-like water delivery member 53 so as to be locally substantially vertically aligned, when detergent drawer 16 is placed in the retracted position, to the regeneration-agent compartment 20 and is structured to pour the fresh water directly into the beneath-located regeneration-agent compartment 20 of detergent drawer 16.

Preferably the water-delivery portion 56 associated to the regeneration-agent compartment 20 is furthermore structured to pour by gravity a shower of water droplets directly into the beneath-located regeneration-agent compartment 20 of detergent drawer 16.

In other words, the drawer flush circuit 19 is preferably structured for pouring by gravity a shower of water droplets selectively and alternatively into any one of the detergent compartments 17 and into the regeneration-agent compartment 20.

Figure 19:
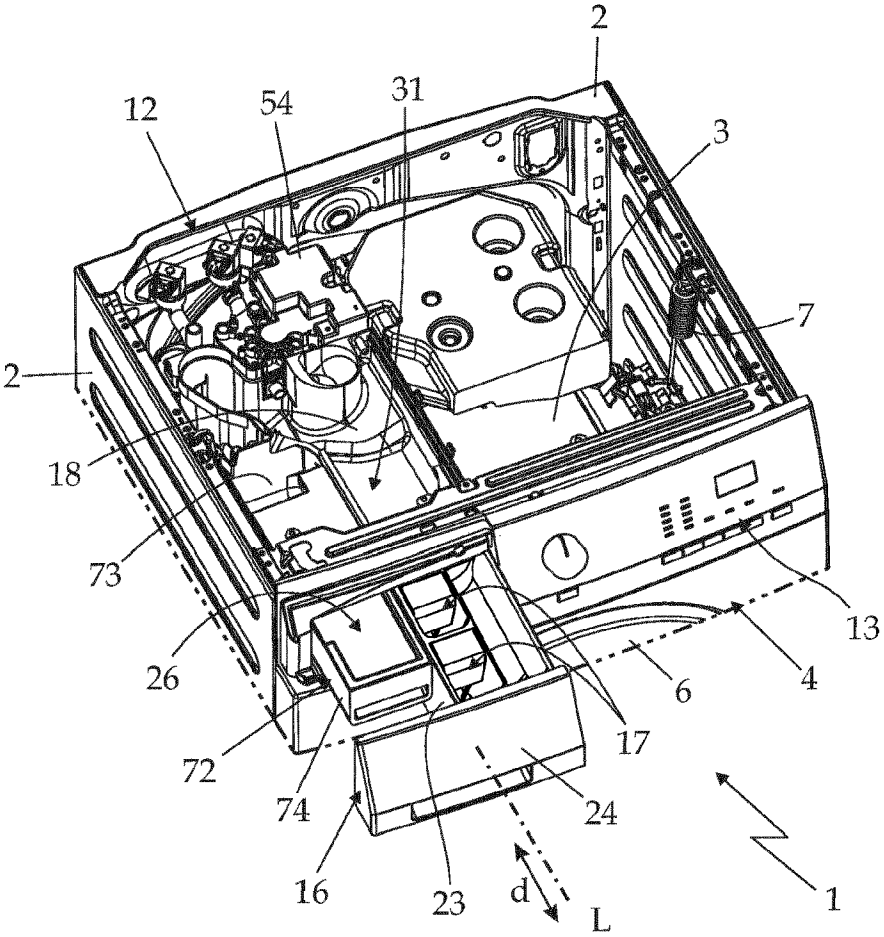
FIGS. 18 and 19 are perspective views of the top portion of two further embodiments of the FIG. 1 laundry washing machine, with parts removed for clarity.

With reference to FIG. 19, in a further alternative embodiment, the regeneration-agent compartment 20 is located into a manually extractable, regeneration-agent drawer 72 which is discrete from detergent drawer 16, and is fitted/inserted in manually extractable manner into a corresponding substantially basin-shaped, drawer housing 73 which is preferably located/recessed inside casing 2 horizontally beside the detergent dispenser 10.

In this embodiment, therefore, the regeneration-agent compartment 20 is formed into the drawer-like supporting structure 74 of said regeneration-agent drawer 72, and the upper lid assembly 26, if present, is arranged/located on drawer-like supporting structure 74, on top of regeneration-agent compartment 20.

Preferably detergent drawer 16 and regeneration-agent drawer 72 are furthermore independently movable inside the respective drawer housings 18, 73 parallel to one another.

In this embodiment, therefore, the drawer housing 73 that accommodates regeneration-agent drawer 72 has its own basin-shaped bottom portion for receiving the brine dripping/falling down from the regeneration-agent compartment 20 through the large pass-through draining opening 21; and brine container 34 is firmly attach to the bottom of drawer housing 73 and is fluidically connected to the basin-shaped bottom portion of the same drawer housing 73 so as to allow the brine to freely flow by gravity from the drawer housing 73 directly into brine container 34.

Alike detergent drawer 16, the regeneration-agent drawer 72 is movable in a substantially horizontally-oriented, displacement direction between:

a retracted position in which regeneration-agent drawer 72 is almost completely recessed into the front wall 4 of casing 2 and the regeneration-agent compartment 20 is inaccessible to the user; and a completely extracted position in which regeneration-agent drawer 72 partly juts out from the front wall 4 of casing 2, so that the regeneration-agent compartment 20 is fully accessible to the user prior opening of the upper lid assembly 26.

More in detail, with reference to FIG. 19, in the example shown drawer housing 73 is preferably realized in one piece with drawer housing 18, and the plate-like water delivery member 53 of drawer flush circuit 19 is preferably structured to form the upper lid of both drawer housings 18 and 73. Detergent drawer 16 and regeneration-agent drawer 72 are independently movable parallel and adjacent to one another, along a same substantially horizontally-oriented, displacement direction d which is locally substantially parallel to the longitudinal axis L of both drawer housings 18 and 73.

Furthermore, even if regeneration-agent compartment 20 is no more formed/incorporated in the drawer-like supporting structure 23 of detergent drawer 16, the manually-sizable front panel 24 of detergent drawer 16 is preferably still dimensioned to close, when detergent drawer 16 is placed in the retracted position, both the entrance of drawer housing 18 and the adjacent entrance of drawer housing 73. Thus the axial displacement of regeneration-agent drawer 72 towards the completely extracted position is exclusively allowable when detergent drawer 16 is placed in the extracted position.

According to a further not-shown and less-sophisticated embodiment, the drawer flush circuit 19 of detergent dispenser 10 may be structured to solely pour the fresh water of the water mains selectively into any one of the detergent compartments 17 of detergent drawer 16.

In this less-sophisticated embodiment, furthermore, the laundry washing machine 1 may furthermore comprise an auxiliary fresh-water supply line which is directly connectable to the water mains and/or is incorporated into the fresh-water supply circuit 12, and is structured for selectively channelling a flow of fresh water from the water mains directly into the regeneration-agent compartment 20, or better to the upper lid assembly 26 arranged/located on top of regeneration-agent compartment 20. This auxiliary fresh-water supply line is therefore discrete from drawer flush circuit 19.

More in detail, this auxiliary fresh-water supply line may comprise a further independent electrically-operated, on-off valve which is separately connectable to the water mains; and a hosepipe directly connecting said further electrically-operated, on-off valve to an hydraulic connector which is stationary inside the drawer housing 18 or 73 and is structured to couple, when detergent drawer 16 or regeneration-agent drawer 72 is placed in the retracted position, in detachable manner with the water inlet 29 of the upper lid assembly 26, so as to put the upper lid assembly 26 in fluid communication with said hosepipe.

In this embodiment, therefore, the regeneration-agent compartment 20, or the upper lid assembly 26 if present, receives the fresh water directly from the water mains bypassing the drawer flush circuit 19.

Lastly, in a non-shown alternative embodiment of laundry washing machine 1, the laundry loading/unloading opening is located on the upper worktop or top wall 11 of boxlike casing 2, and the washing tub 3 is arranged inside casing 2 with the mouth directly facing the upper worktop or top wall 11. The rotatable drum, in turn, is fitted vertically into washing tub 3 with the concavity facing the upper mouth of washing tub 3, so as to be able to rotate about a substantially vertically-oriented, longitudinal axis.

The invention claimed is:

1. A laundry washing machine comprising an outer casing and, inside said outer casing, a washing tub, a rotatable drum housed in an axially rotatable manner inside the washing tub configured to house laundry to be washed, a detergent dispenser configured to supply detergent to the washing tub, a fresh-water supply circuit configured to selectively channel a flow of fresh water from the water mains towards the detergent dispenser and/or the washing tub, and an internal water softening device comprising a water-softening-agent container filled with a water softening agent that reduces the hardness degree of the fresh water directed towards the detergent dispenser or the washing tub;

the laundry washing machine further comprising: at least a main drawer fitted/inserted in an extractable manner into a corresponding substantially basin-shaped, drawer housing located inside the outer casing, and which is provided with a substantially basin-shaped, regeneration-agent compartment configured to be manually fillable with a given amount of consumable salt or other regeneration agent that performs a regeneration of the water softening function of said water softening agent; and a water-supply line configured to selectively channel a flow of fresh water into said regeneration-agent compartment so as to form brine;

wherein the drawer housing has a substantially basin-shaped, bottom portion configured to catch the brine coming out of said regeneration-agent, and a brine container located underneath the drawer housing and in fluid communication with the substantially basin-shaped, bottom portion so as to allow the brine to freely flow by gravity from said basin-shaped bottom portion into the brine container, and wherein an electrically-powered pump assembly is configured to selectively pump the brine from said brine container the water softening device.

2. The laundry washing machine according to claim 1, wherein the brine container comprises a tank which is distinct and separated from said drawer housing, and is provided with a first mechanical coupling configured to rigidly fasten and/or fluidical connect the tank to the bottom portion of said drawer housing.

3. The laundry washing machine according to claim 2, wherein said tank is provided with a second mechanical coupling configured to rigidly fasten and/or fluidical connect the tank to the water-softening-agent container of said water softening device.

4. The laundry washing machine according to claim 3, wherein the water-softening-agent container of said water softening device is provided with a third coupling configured to fasten the water-softening-agent container to said drawer housing.

5. The laundry washing machine claim 2, wherein said brine container additionally comprises a sensor configured to detect a level of the water stored inside the tank and/or a salinity degree of the water stored into the tank.

6. The laundry washing machine according to claim 2, wherein said tank is dimensioned to contain an amount of brine approximately equal to a whole amount of brine to be pumped into the water-softening-agent container of said water softening device for performing the regeneration process of the water softening agent contained into the same water-softening-agent container.

7. The laundry washing machine according to claim 2, wherein said tank is dimensioned to contain an amount of brine approximately equal to a submultiple of a whole amount of brine to be pumped into the water-softening-agent container of said water softening device for performing the regeneration process of the water softening agents contained into the same water-softening-agent container.

8. The laundry washing machine according to claim 2, wherein said tank is dimensioned to contain an amount of brine greater than 100 ml.

9. The laundry washing machine according to claim 2, wherein said tank has, on top, a first opening for an entrance of the brine and a second opening for an air vent.

10. The laundry washing machine according to claim 2, wherein said tank directly communicates with the basin-shaped bottom portion of the drawer housing via a first vertical pipe-extension that protrudes downwards from the bottom of the drawer housing and fits into a complementary brine inlet opening formed on a top wall of said tank.

11. The laundry washing machine according to claim 10, wherein said tank is configured to fluidically communicate with an inside of the drawer housing via a second vertical pipe-extension that protrudes downwards from the bottom of the drawer housing and fits into a complementary air vent opening formed on a top wall of said tank, next to the brine inlet opening.

12. The laundry washing machine according to claim 11, wherein said second vertical pipe-extension additionally protrudes upwards into the drawer housing within a perimeter of said basin-shaped bottom portion, so as to arrange its upper mouth at a given high from the basin-shaped bottom portion thus to prevent the brine from freely falling into the same tank.

13. The laundry washing machine according to claim 1, wherein the brine container is a discrete modular member which is firmly attached to the water-softening-agent container of said water softening device with the interposition of said pump assembly.

14. The laundry washing machine according to claim 13, wherein said pump assembly remains trapped between the water-softening-agent container of said water softening device and said brine container.

15. The laundry washing machine according to claim 13, wherein said tank and said water-softening-agent container form, when coupled to one another and in between themselves, a receiving seat dimensioned to accommodate said pump assembly.

16. The laundry washing machine according to claim 13, wherein said tank, said water softening device and said pump assembly form a discrete intermediate modular assembly which is attached to said drawer housing.

17. The laundry washing machine according to claim 1, wherein said main drawer additionally comprises a partitioning septum which extends inside the regeneration-agent compartment above a brine outlet of the regeneration-agent compartment, and has a water-permeable structure which is designed to slow down the outflow of the brine from the regeneration-agent compartment via the brine outlet for causing a temporary stagnation of the water poured into the regeneration-agent compartment above the partitioning septum.

18. The laundry washing machine according to claim 17, wherein said brine outlet is a pass-through opening which is formed on the bottom of the regeneration-agent compartment, and is shaped/dimensioned to allow the brine formed inside the regeneration-agent compartment to freely fall on the basin-shaped bottom portion of said drawer housing.

19. The laundry washing machine according to claim 17, wherein said partitioning septum is structured to allow the passage of the brine through the same partitioning septum with a flowrate which is lower than that of the fresh water poured into the regeneration-agent compartment via said water-supply line.

20. The laundry washing machine according to claim 17, wherein said partitioning septum causes a temporary increase of the level of water above the same partitioning septum.

21. The laundry washing machine according to claim 17, wherein said partitioning septum causes, during stagnation of the water, a quick increase of the level of water inside the regeneration-agent compartment, up to a maximum value above the partitioning septum, and then a slow lowering of the level of water down to the same partitioning septum.

22. The laundry washing machine according to claim 17, wherein the regeneration-agent compartment remains empty of brine at the end of the temporary stagnation of the water.

23. The laundry washing machine according to claim 1, wherein said pump assembly comprises an electrically-powered volumetric pump.

24. The laundry washing machine according to claim 1, wherein the water-softening-agent container of said water softening device contains a given amount of ion-exchange resins to retain calcium and magnesium ions dissolved in the water that flows through the same water-softening-agent container.

25. The laundry washing machine according to claim 1, wherein the regeneration-agent compartment is dimensioned to accommodate an amount of consumable salt or other regeneration agent sufficient for performing one or more regeneration processes of water softening capabilities of the water softening agent contained into the water-softening-agent container of said water softening device.

* * * * *